US008335336B2

(12) United States Patent
Kuze et al.

(10) Patent No.: US 8,335,336 B2
(45) Date of Patent: Dec. 18, 2012

(54) VIBRATION DEVICE AND ACOUSTIC SYSTEM

(75) Inventors: Mitsukazu Kuze, Mie (JP); Shuji Saiki, Nara (JP); Toshiyuki Matsumura, Osaka (JP)

(73) Assignee: Panasonic Corporation, Osaka (JP)

( * ) Notice: Subject to any disclaimer, the term of this patent is extended or adjusted under 35 U.S.C. 154(b) by 423 days.

(21) Appl. No.: 12/663,955

(22) PCT Filed: Jul. 9, 2008

(86) PCT No.: PCT/JP2008/001837
§ 371 (c)(1),
(2), (4) Date: Dec. 10, 2009

(87) PCT Pub. No.: WO2009/011108
PCT Pub. Date: Jan. 22, 2009

(65) Prior Publication Data

US 2010/0189284 A1 Jul. 29, 2010

(30) Foreign Application Priority Data

Jul. 18, 2007 (JP) ..... 2007-187188

(51) Int. Cl.
*H04R 9/06* (2006.01)

(52) U.S. Cl. ..... 381/396; 381/412; 381/413

(58) Field of Classification Search ..... 381/421, 381/182, 354, 150, 337, 422, 420, 417, 396, 381/412, 419, 413
See application file for complete search history.

(56) References Cited

U.S. PATENT DOCUMENTS

| | | | | |
|---|---|---|---|---|
| 3,688,864 | A * | 9/1972 | Guss | 381/89 |
| 6,574,346 | B1 * | 6/2003 | Tanaka | 381/421 |
| 2004/0105568 | A1 * | 6/2004 | Lee | 381/412 |
| 2006/0269095 | A1 * | 11/2006 | Matsumura et al. | 381/421 |

FOREIGN PATENT DOCUMENTS

| | | |
|---|---|---|
| JP | 2000-308174 | 11/2000 |
| JP | 2002-112387 | 4/2002 |

OTHER PUBLICATIONS

International Search Report issued Aug. 5, 2008 in International (PCT) Application No. PCT/JP2008/001837.

* cited by examiner

*Primary Examiner* — Curtis Kuntz
*Assistant Examiner* — Amir Etesam
(74) *Attorney, Agent, or Firm* — Wenderoth, Lind & Ponack, L.L.P.

(57) ABSTRACT

A vibration device includes a support system member that supports a diaphragm to allow vibration, a tubular voice coil bobbin attached to the diaphragm, and a magnet disposed on at least one of inner and outer circumferential surface sides of the bobbin. The magnet is polarized in a vibration direction of the diaphragm, and forms a magnetic gap on a side that faces the bobbin. A voice coil is attached to the bobbin and disposed within the magnetic gap, and vibrates the diaphragm and the bobbin in response to a driving force generated when an electrical signal is inputted into the voice coil. A magnetic material member is attached to the bobbin, disposed in a balancing position within the magnetic gap, and, when vibrating with the bobbin, subjected to a magnetic attractive force in a direction away from the balancing position.

20 Claims, 33 Drawing Sheets

VIBRATION DEVICE AND ACOUSTIC SYSTEM

TECHNICAL FIELD

The present invention relates to a vibration device and an acoustic system. More specifically, the present invention relates to: a vibration device that generates a negative stiffness which reduces an acoustic stiffness of a cabinet; and an acoustic system that achieves, by using the vibration device therein, an advantageous effect of a large size cabinet even when used in a small size cabinet.

BACKGROUND ART

When a loudspeaker unit is utilized in an acoustic system which is a loudspeaker system, generally, an enclosure which is realized by a cabinet is provided on a back surface of the loudspeaker unit. This is provided in order to prevent a radiated sound from a front surface of a loudspeaker diaphragm to be cancelled by an opposite phase sound radiated from the back surface. However, in such a case, the loudspeaker diaphragm is prevented from moving freely due to a stiffness resulting from an air pressure inside the cabinet (hereinafter, referred to as an acoustic stiffness). As a result, a problem arises where of the whole acoustic system increases, leading to an inhibition of a reproduction of low frequencies.

Therefore, conventionally, in order to reduce the acoustic stiffness of the cabinet, a vibration device that generates a negative stiffness by using a magnetic attractive force by means of a magnet is suggested (e.g. patent document 1). FIG. 30 shows a structure of a conventional vibration device 91 that generates the negative stiffness. In FIG. 30, the vibration device 91 includes: a voice coil bobbin 910; a voice coil 911; a support member 912; a magnetic pole 913*a*; a magnetic pole 913*b*; a pole piece 914; a diaphragm 915; an edge 916; a damper 917; a frame 918; a yoke 919; a magnet 920; and a plate 921. FIG. 31 shows a structure of a sealed-type acoustic system 9 in which the vibration device 91 is applied. In FIG. 31, the acoustic system 9 includes: the vibration device 91; and a cabinet 93 attached to the vibration device 91.

In FIG. 30, the yoke 919 is fixed on a bottom surface of the frame 918. The magnet 920 is fixed on the yoke 919, and the plate 921 is fixed on an upper surface of the magnet 920. A magnetic gap is formed between the plate 921 and the yoke 919. The voice coil bobbin 910 is a tubular member, and the voice coil 911 is provided on an outer circumferential surface of the voice coil bobbin 910. The voice coil 911 is disposed within the magnetic gap. The support member 912 is provided on an upper surface of the plate 921 and on an inner circumferential surface side of the voice coil bobbin 910. The magnetic pole 913*a* and the magnetic pole 913*b* are magnets. The magnetic pole 913*a* is provided on an upper portion of an outer circumferential surface of the support member 912; and the magnetic pole 913*b* is provided on a lower portion of an outer circumferential surface of the support member 912. The pole piece 914 consists of a magnetic material such as iron, and is interposed between the magnetic pole 913*a* and the 913*b* in an inner circumferential surface of the voice coil bobbin 910. When the vibration device 91 is in a non-operating state, the pole piece 914 is normally disposed in a balancing position, where magnetic attractive forces by the magnetic pole 913*a* and by the magnetic pole 913*b* equilibrate. The pole piece 914 vibrates having the balancing position as a center. An outer circumferential surface of the edge 916 is fixed on the frame 918; and an inner circumferential surface of the edge 916 is fixed on an outer circumferential surface of the diaphragm 915. An inner circumferential surface of the diaphragm 915 is fixed on the voice coil bobbin 910. An outer circumferential surface of the damper 917 is fixed on the frame 918; and an inner circumferential surface of the damper 917 is fixed on the outer circumferential surface of the voice coil bobbin 910.

An operation of the vibration device 91 that is configured as described above will be described in the following. When an acoustic signal such as an audio signal is inputted into the voice coil 911, the voice coil 911 vibrates up and down, and a sound is radiated from the diaphragm 915. As the voice coil 911 vibrates, the pole piece 914 also vibrates. At this moment, the magnetic attractive force by the magnetic pole 913*a* and the magnetic attractive force by the magnetic pole 913*b* act upon the pole piece 914 in directions away from the balancing position. On the other hand, when the vibration device 91 is attached to the cabinet 93 as shown in FIG. 31, the acoustic stiffness inside the cabinet 93 acts upon the diaphragm 915. The acoustic stiffness acts in an opposite direction of the magnetic attractive force that acts upon the pole piece 914. The magnetic attractive force that acts upon the pole piece 914 is a force that reduces the acoustic stiffness, and is a force referred to as the negative stiffness.

When, a stiffness of a support system such as the edge 916 and the damper 917 is defined as Sms, a negative stiffness caused by the magnetic attractive force is defined as Smn, an acoustic stiffness inside the cabinet 93 is defined as Smb, and a vibration system weight of the diaphragm 915 and the like is defined as Mmt, a minimum resonant frequency fo1 of the whole acoustic system 9 can be described by formula (1). On the other hand, a minimum resonant frequency fo2 of the whole acoustic system, in which a general loudspeaker unit that does not generate the negative stiffness is used, can be described by formula (2).

[Formula 1]

$$fo1=1/(2\pi)\times\{(Sms+Smb-Smn)/Mmt\}^{1/2} \quad (1)$$

[Formula 2]

$$fo2=1/(2\pi)\times\{(Sms+Smb)/Mmt\}^{1/2} \quad (2)$$

As obvious from formula (1) and formula (2), the minimum resonant frequency fo1 of the acoustic system 9 is lower than the minimum resonant frequency fo2. When, an effective area of the diaphragm 915 is defined as Sd, the density of air is defined as ρ, the speed of sound is defined as c, and an internal capacity of the cabinet 93 is defined as Vb; the acoustic stiffness Smb inside the cabinet 93 is inversely proportional to the internal capacity Vb, and can be described by formula (3).

[Formula 3]

$$Smb=Sd^2\times\rho c^2/Vb \quad (2)$$

Here, the stiffness of the support system Sms and the acoustic stiffness Smb inside the cabinet 93 are identical values in formula (1) and in formula (2). Thus, the negative stiffness Smn is a reduction factor when the minimum resonant frequency fo1 of formula (1) is compared to the minimum resonant frequency fo2 of formula (2). This has the same meaning of a reduction of the acoustic stiffness Smb, and also the same meaning of expanding the internal capacity of the cabinet 93. When, the effective area of the diaphragm 915 is defined as Sd, the density of air is defined as ρ, the speed of sound is defined as c, and an apparent internal capacity of the cabinet 93 when the negative stiffness Smn is acting thereon is defined as Vbn; formula (4) describes a relationship of the internal capacity Vbn, and stiffnesses that act upon the diaphragm 915.

[Formula 4]

$$Smb-Smn=Sd^2\times\rho c^2/Vbn \quad (4)$$

Furthermore, from formula (3) and formula (4), a rate of change of the internal capacity due to the negative stiffness is represented as formula (5).

[Formula 5]

$$Vbn/Vb=Smb/(Smb-Smn) \quad (5)$$

As shown in formula (5), the acoustic stiffness Smb becomes apparently smaller due to the negative stiffness Smn that acts to reduce the acoustic stiffness Smb. As a result, the internal capacity of the cabinet 93 expands apparently (i.e. equivalently). Therefore, by using the acoustic system 9 that adopts the sealed-type, a reproduction of a low frequency range can be attained at a level similar to a large-sized cabinet even when used in a small size cabinet.

[Patent Document 1] Japanese Laid-Open Patent Publication No. 2002-112387

SUMMARY OF THE INVENTION

Problems to be Solved by the Invention

However, in the conventional vibration device 91, the magnetic pole 913*a* and the magnetic pole 913*b* are disposed in positions where the pole piece 914 makes contact when the pole piece 914 vibrates. Thus, the conventional vibration device 91 cannot ensure a large vibrational amplitude.

Furthermore, the magnetic attractive force that acts upon the pole piece 914 becomes larger inversely proportional to a square of a distance between the pole piece 914, and the magnetic pole 913*a* or the magnetic pole 913*b*. Therefore, a problem arises where once the pole piece 914 makes contact with the magnetic pole 913*a* or the magnetic pole 913*b*, due to the strong magnetic attractive force, the contact is maintained and vibration itself is disabled.

Therefore, an objective of the present invention is to provide: a vibration device that can generate a negative stiffness while ensuring a large vibrational amplitude; and an acoustic system in which the vibration device is applied.

Solution to the Problems

A vibration device according to the present invention is one that solves the above-described problem. The vibration device according to the present invention is a vibration device that vibrates in response to an input electrical signal, and the vibration device includes: a diaphragm; a support system member that supports the diaphragm in a manner that allows the diaphragm to vibrate; a tubular voice coil bobbin attached to the diaphragm; a magnet which is disposed on at least one side among an inner circumferential surface side and an outer circumferential surface side of the voice coil bobbin, and which is polarized in a vibration direction of the diaphragm, and which forms a magnetic gap on a side that faces the voice coil bobbin; a voice coil which is attached to the voice coil bobbin so as to be disposed within the magnetic gap, and which vibrates the diaphragm and the voice coil bobbin in response to a driving force that is generated when the input electrical signal is inputted in the voice coil; and a magnetic material member which is attached to the voice coil bobbin so as to be disposed in a balancing position within the magnetic gap, and which is, when vibrating together with the voice coil bobbin, subjected to an action of a magnetic attractive force in a direction away from the balancing position.

The vibration device according to the present invention can realize a structure that does not allow any contact between the magnet and the magnetic material member; since the magnetic gap is formed on the side of the magnet facing the voice coil bobbin, and the magnetic material member is disposed within the magnetic gap. With this, the negative stiffness can be generated while ensuring a large vibrational amplitude. Furthermore, in the vibration device according to the present invention, the magnetic gap is formed by a single magnet, thus allowing the driving force to be generated by the voice coil as a result of disposing the voice coil within the magnetic gap, and allowing the negative stiffness to be generated by subjecting the magnetic material member with the action of the magnetic attractive force as a result of disposing the magnetic material member within the magnetic gap. As described above, with the vibration device according to the present invention, a magnet for driving the voice coil and a magnet for generating the negative stiffness are attained by a single magnet. As a result, when compared to a conventional art where a magnet for generating the negative stiffness has to be prepared separately, the number of the magnets can be reduced.

More preferably included is a plate formed from a magnetic material, which is attached to at least one surface among two magnetic pole surfaces of the magnet.

More preferably, the magnet is disposed on each of the inner circumferential surface side and an outer circumferential surface side of the voice coil bobbin; and a polarization direction of a magnet that is disposed on the inner circumferential surface side and a polarization direction of a magnet that is disposed on the outer circumferential surface side, are opposite. Furthermore, a thickness, in the vibration direction of the diaphragm, of the magnet that is disposed on the inner circumferential surface side is larger than a thickness, in the vibration direction of the diaphragm, of the magnet that is disposed on the outer circumferential surface side.

The present invention is also directed toward an acoustic system, and the acoustic system according to the present invention includes: a cabinet; and the vibration device attached to the cabinet.

More preferably included is control means that outputs, to the voice coil, as the input electrical signal, a control signal for controlling a vibration center of the magnetic material member to be in the balancing position. Furthermore, the control means preferably includes: a detection section which detects a vibrational displacement of the magnetic material member, and which outputs a displacement signal that indicates the detected vibrational displacement; a low pass filter that allows, among the displacement signals outputted from the detection section, only a displacement signal having a frequency lower than an audible range to pass through; an amplification section that amplifies, with a predefined gain, the displacement signal which has passed through the low pass filter; and a phase inversion section which inverts a phase of the displacement signal amplified by the amplification section, and which outputs, to the voice coil, the resulting signal as the control signal. Furthermore, the voice coil is provided in plural numbers while each voice coil is attached to the voice coil bobbin so as to be disposed within the magnetic gap at positions away from each other in the vibration direction of the diaphragm; and the phase inversion section outputs the control signal to each voice coil. Furthermore, a relationship of $Ga>(Re\cdot Sm)/(B\cdot 1\cdot Gx)$ is satisfied, when the predefined gain is defined as Ga, a direct current resistance of the voice coil is defined as Re, a stiffness that acts upon the diaphragm is defined as Sm, a magnetic flux density within the magnetic gap is defined as B, a coil length of the voice coil is defined as 1, and a gain of the detection section is defined as Gx.

More preferably included is a gas adsorption body which is disposed inside the cabinet, and which has an advantageous effect of equivalently expanding a capacity inside the cabinet, by physically adsorbing a gas inside the cabinet.

Furthermore, the present invention is also directed toward an acoustic system, and the acoustic system according to the present invention includes: a cabinet; a partition plate which is provided inside the cabinet so as to divide a cavity inside the cabinet into a first cavity and a second cavity; a loudspeaker unit which is attached to the cabinet so as to be in contact with the first cavity, and which generates a sound in accordance with an inputted acoustic signal; and the vibration device attached to the partition plate.

More preferably further included is either a drone cone or an acoustic port, which is attached to the cabinet so as to be in contact with the first cavity, and which acoustically connects the first cavity and the outside of the cabinet.

More preferably included is a gas adsorption body which is disposed inside the second cavity, and which has an advantageous effect of equivalently expanding a capacity inside the second cavity, by physically adsorbing a gas inside the second cavity.

Furthermore, the present invention is also directed toward a vehicle, and the vehicle includes: the above described vibration device; and a vehicle body in which the above described vibration device is provided. Furthermore, the present invention is also directed toward an audio-visual apparatus, and the audio-visual apparatus includes: the above described vibration device; and an apparatus chassis in which the above described vibration device is provided. Still further, the present invention is also directed toward a portable information processing device, and the portable information processing device includes: the above described vibration device; and a device chassis in which the above described vibration device is provided.

EFFECT OF THE INVENTION

According to the present invention, a vibration device that can generate a negative stiffness while ensuring a large vibrational amplitude, and an acoustic system in which the vibration device is applied, can be provided.

DESCRIPTION OF THE REFERENCE CHARACTERS

Figure 1:
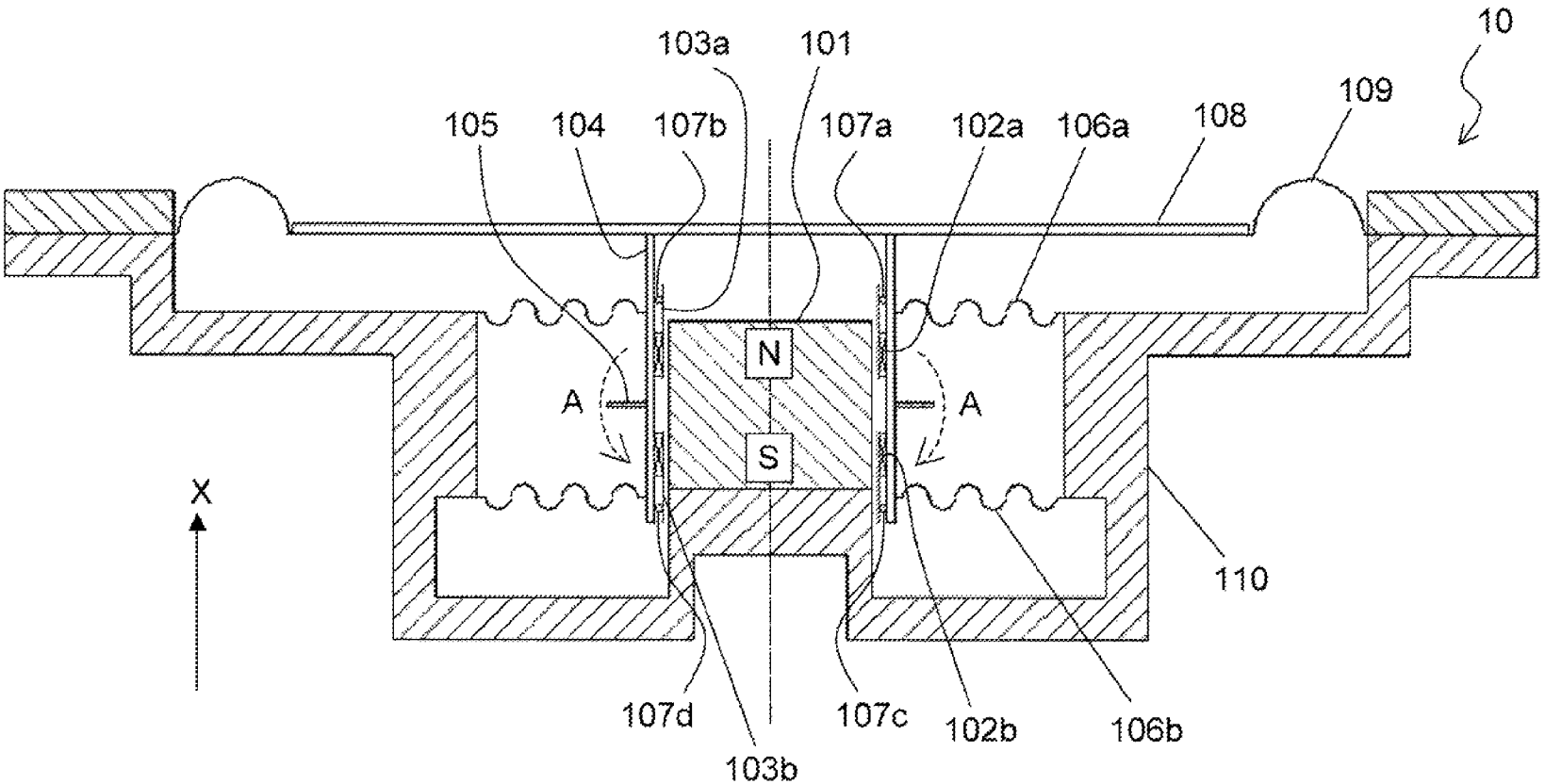
FIG. 1 is a structural profile of a vibration device 10.

1 to 3 acoustic system
10 to 20 vibration device
11 cabinet
12, 12*a* control section
13 loudspeaker unit
14 partition plate
15 acoustic port
16 drone cone
17 gas adsorption body
101, 101*a* magnet
102*a*, 102*b* voice coil
103*a*, 103*b* first voice coil bobbin
104 second voice coil bobbin
105 magnetic material member
106*a*, 106*b* damper
107*a* to 107*d* input terminal
108 diaphragm
109 edge
110 frame
111*a*, 111*b*, 112*a*, 112*b* plate
113*a*, 113*b* support member
121 detection section
122 low pass filter
123 adder
124 amplification section
125 phase inversion section
50 thin-screen television
501 liquid crystal display
502 apparatus chassis
51 mobile phone
511 device chassis
512 hinge portion
513 liquid crystal display
514 antenna
52 automobile door
521 window section
522 door main body
523 punching net

DETAILED DESCRIPTION OF THE INVENTION

Embodiments of the present invention will be described in the following with reference to the drawings.

(First Embodiment)

With reference to FIG. 1, a structure of a vibration device 10 according to a first embodiment will be described. FIG. 1 is a structural profile of the vibration device 10. X-axis is described in FIG. 1 in order to conveniently describe directions. In FIG. 1, the vibration device 10 includes: a magnet 101; a voice coil 102*a*; a voice coil 102*b*; a first voice coil bobbin 103*a*; a first voice coil bobbin 103*b*; a second voice coil bobbin 104; a magnetic material member 105; a damper 106*a*; a damper 106*b*; input terminals 107*a* to 107*d*; a diaphragm 108; an edge 109; and a frame 110. The voice coil 102*a*, the voice coil 102*b*, the first voice coil bobbin 103*a*, the first voice coil bobbin 103*b*, the second voice coil bobbin 104, the magnetic material member 105, the input terminals 107*a* to 107*d*, and the diaphragm 108 are members that vibrate in response to an inputted electrical signal, and are combined and referred to as a vibration system member in the following description in some cases. Furthermore, the damper 106*a*, the damper 106*b*, and the edge 109 are members that support the above described vibration system member in a manner that allows the vibration system member to vibrate, and are combined and referred to as a support system member in the following description in some cases.

In FIG. 1, the second voice coil bobbin 104 is a tubular member. The first voice coil bobbin 103*a* is provided on an inner circumferential surface upper portion of the second voice coil bobbin 104, and the first voice coil bobbin 103*b* is provided on an inner circumferential surface lower portion of the second voice coil bobbin 104. The first voice coil bobbin 103*a* and the first voice coil bobbin 103*b* are tubular members. The voice coil 102*a*, and the input terminals 107*a* and 107*b*, are provided on an outer circumferential surface of the first voice coil bobbin 103*a*. The voice coil 102*b*, and the input terminals 107*c* and 107*d*, are provided on an outer circumferential surface of the first voice coil bobbin 103*b*. The input terminals 107*a* to 107*d* are provided in order to input an electrical signal from outside to the voice coil 102*a* and to the voice coil 102*b*. The diaphragm 108 is fixed on an upper end of the second voice coil bobbin 104. An outer circumferential surface of the diaphragm 108 is fixed on an inner circumferential surface of the edge 109, and an outer circumferential surface of the edge 109 is fixed on the frame 110. An outer circumferential surface of the second voice coil bobbin 104 is fixed on inner circumferential surfaces of the damper 106*a* and the damper 106*b*, and outer circumferential surfaces of the damper 106*a* and the damper 106*b* are fixed on the frame 110. The magnetic material member 105 is provided on the outer circumferential surface of the second voice coil bobbin 104 between the damper 106*a* and the damper 106*b*. The magnetic material member 105 is constructed from a strong magnetic material such as iron and a magnet. The magnet 101 fixed on the frame 110 is disposed on inner circumferential surface sides of the first voice coil bobbin 103*a* and the first voice coil bobbin 103*b*. The magnet 101 is polarized in a vibration direction (X-axis direction) of the diaphragm 108. In the example in FIG. 1, the upper surface of the magnet 101 is the magnetic pole surface that bears the N pole, and the lower surface is the magnetic pole surface that bears the S pole. When the vibration device 10 is in a non-operating state, the magnetic material member 105 is disposed in a balancing position where magnetic attractive forces by both magnetic pole surfaces of the magnet 101 equilibrate. The magnetic material member 105 vibrates having the balancing position as a center.

Next, an operation of the vibration device 10 shown in FIG. 1 will be described. Since the magnet 101 is polarized in the vibration direction (X-axis direction), the magnet 101 generates a magnetic flux as shown by A in FIG. 1, resulting in a formation of a magnetic gap. This magnetic gap is formed sideward of the magnet 101, that is, a side that faces the second voice coil bobbin 104. As it is obvious from FIG. 1, the voice coil 102*a* and the voice coil 102*b* are disposed within the magnetic gap. Therefore, when the electrical signal is inputted into the voice coil 102*a* and the voice coil 102*b*, a driving force is generated, and the vibration system member vibrates because of the driving force. The vibration device 10 performs an operation similar to a general loudspeaker unit when an acoustic signal such as an audio signal is inputted into the voice coil 102*a* and the voice coil 102*b*.

Furthermore, the magnetic material member 105 is disposed within the magnetic gap. Therefore, when the vibration system member vibrates, the magnetic attractive force by the magnetic flux A acts upon the magnetic material member 105 in a direction away from the balancing position. More specifically, when the magnetic material member 105 is displaced upwards, the magnetic attractive force acts upwards; and when the magnetic material member 105 is displaced downwards, the magnetic attractive force acts downwards. As described here, the magnetic attractive force is a force that acts in a direction that reduces an acoustic stiffness which is later described, and is a force referred to as a negative stiffness.

As described above, in the vibration device 10 according to the current embodiment, the magnetic material member 105 is disposed within the magnetic gap formed sideward of the magnet 101, realizing a structure that does not allow any contacts between the magnetic material member 105 and the magnet 101 even when the magnetic material member 105 vibrates. With such a structure, the negative stiffness can be generated while ensuring a large vibrational amplitude.

Furthermore, in the vibration device 10 according to the current embodiment: the magnetic gap is formed by the single magnet 101; the driving force is generated by the voice coil 102*a* and by the voice coil 102*b* as a result of disposing the voice coil 102*a* and the voice coil 102*b* within the magnetic gap; and the negative stiffness is generated as a result of disposing the magnetic material member 105 within the magnetic gap allowing the magnetic material member 105 to be subjected with the action of the magnetic attractive force. As described above, in the vibration device 10, a magnet for driving the voice coil 102*a* and the voice coil 102*b*, and a magnet for generating the negative stiffness, are attained by the single magnet 101. As a result, when compared to a conventional art where it is necessary to separately prepare a magnet for generating the negative stiffness, the number of the magnets can be reduced.

Figure 2:
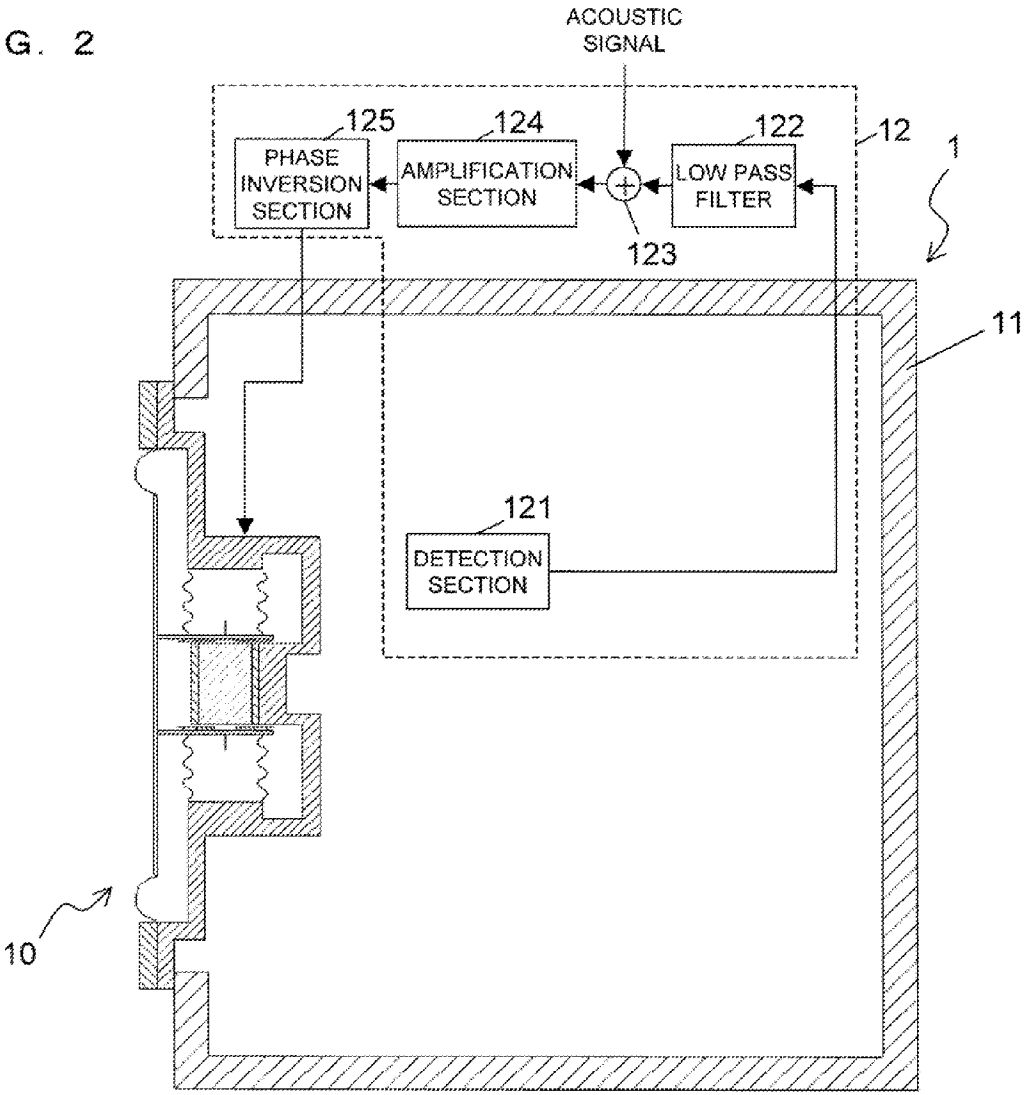
FIG. 2 is a structural profile of an acoustic system 1.

Next, with reference to FIG. 2, an acoustic system 1 in which the vibration device 10 is applied will be described. FIG. 2 is a structural profile of the acoustic system 1. In an example in FIG. 2, a sealed-type loudspeaker system is adopted as the acoustic system. In FIG. 2, the acoustic system 1 includes: the vibration device 10; a cabinet 11; a control section 12. The vibration device 10 is attached to the cabinet 11. Since the vibration device 10 shown in FIG. 2 is identical to the vibration device 10 shown in FIG. 1, a detailed description thereof is omitted in the following.

In FIG. 2, the control section 12 outputs, to the voice coil 102*a* and the voice coil 102*b*, the acoustic signal and the control signal for controlling the vibration center of the magnetic material member 105 to be in the balancing position. More specifically, the control section 12 includes: a detection section 121; a low pass filter 122; an adder 123; an amplification section 124; and a phase inversion section 125. The detection section 121 detects a vibrational displacement of the magnetic material member 105, and outputs a displacement signal that indicates the detected vibrational displacement to the low pass filter 122. Furthermore, instead of directly detecting the vibrational displacement of the magnetic material member 105, the detection section 121 may detect a vibrational displacement of the diaphragm 108 as the vibrational displacement of the magnetic material member 105. The detection section 121 is constructed from a sensor, such as a laser displacement meter and a light sensor (PSD: Position Sensitive Detector), which can detect a position. Furthermore, the detection section 121 may be constructed from a velocity sensor and the like. In this case, it is necessary to perform integration and convert the displacement signal from the detection section 121 into positional information.

Among the displacement signals from the detection section 121, the low pass filter 122 allows only a displacement signal that has a frequency bandwidth which is close to a direct current to pass through, and outputs the resulting signal to the adder 123. A frequency bandwidth that is close to a direct current is a frequency bandwidth that only has a frequency including a positional fluctuation of the vibration center of the magnetic material member 105. The positional fluctuation of the vibration center of the magnetic material member 105 will be described below in detail. In practice, a frequency that is at least lower than the audible range may be configured as a cut-off frequency for the low pass filter 122. The reason for this will also be described below. Furthermore, in FIG. 2, although the low pass filter 122 is provided in a subsequent stage of the detection section 121, the low pass filter 122 may be provided in a subsequent stage of the amplification section 124.

The displacement signal which passed through the low pass filter 122, and the acoustic signal such as the audio signal, are inputted into the adder 123 and are added, and the resulting signal is outputted to the amplification section 124. The amplification section 124 amplifies the output signal from the adder 123 with a predefined gain, and outputs the resulting signal to the phase inversion section 125.

The phase inversion section 125 inverts the phase of the output signal from the amplification section 124, and outputs the resulting signal to the voice coil 102*a* and to the voice coil 102*b*. Among the output signals from the phase inversion section 125, a signal obtained as a result of inverting the displacement signal that passed through the low pass filter 122 corresponds to a control signal that allows the voice coil 102*a* and the voice coil 102*b* to generate a driving force in a direction toward the balancing position.

Next, an operation of the acoustic system 1 configured as above will be described. As described above, in an operating state (a state when the vibration system member vibrates), in the vibration device 10, the negative stiffness is generated by the magnet 101 and by the magnetic material member 105. With this, the acoustic stiffness of the cabinet 11 is reduced. As a result, by using the acoustic system 1, a capacity inside the cabinet 11 equivalently expands, making it possible to attain a reproduction of a low frequency range at a level that is similar to a large-sized cabinet even when used in a small size cabinet 11.

Figure 3:
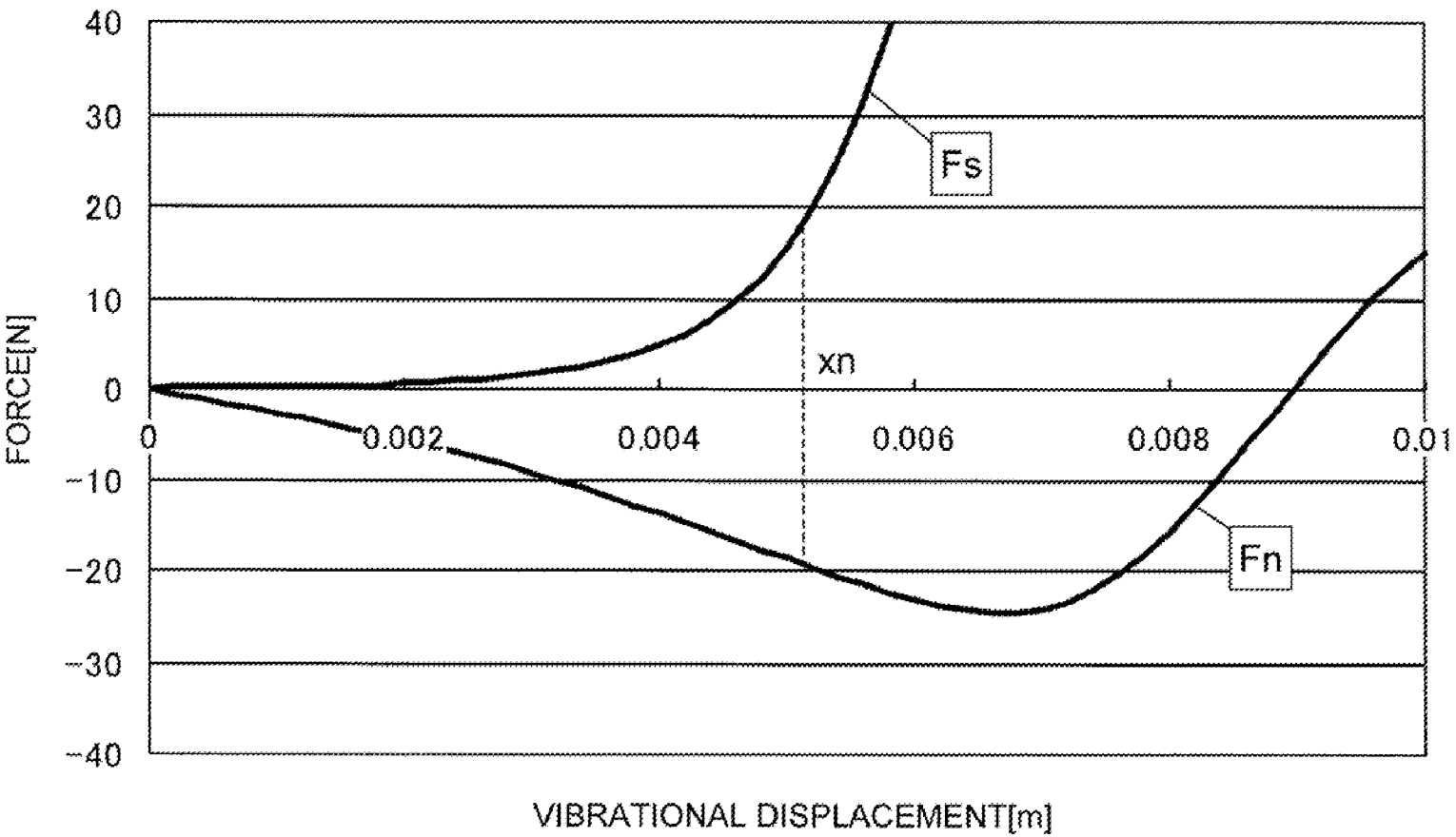
FIG. 3 is a figure showing: a relationship between a magnetic attractive force Fn of the vibration device 10 alone and a vibrational displacement x; and a relationship between a supporting force Fs and the vibrational displacement x.

However, the vibration device 10 cannot always stably generate the negative stiffness. The reason for this will be described specifically in the following. First, considered is a case with the vibration device 10 by itself. When, the magnetic attractive force, which is the negative stiffness that acts upon the magnetic material member 105, is defined as Fn, and a supporting force, which is a stiffness of a support system, is defined as Fs: a relationship between the magnetic attractive force Fn of the vibration device 10 alone and the vibrational displacement x, and a relationship between the supporting force Fs and the vibrational displacement x, become relationships shown in FIG. 3. FIG. 3 is a figure showing: the relationship between the magnetic attractive force Fn of the vibration device 10 alone and the vibrational displacement x; and a relationship between the supporting force Fs and the vibrational displacement x. In FIG. 3, a positive direction of the vibrational displacement x is defined as the positive direction of the X-axis in FIG. 1, a force that acts in the positive direction of the X-axis is represented as "−", and a force that acts in the X-axis negative direction is represented as "+". Additionally in FIG. 3, a displacement x=0 is the balancing position.

In FIG. 3, when the vibration system member moves toward the positive direction of the vibrational displacement x, the magnetic attractive force Fn acts in the positive direction of the vibrational displacement x, and the supporting force Fs acts in the negative direction of the vibrational displacement x. In FIG. 3, |Fn|>|Fs| is satisfied in a range of x=0 to xn. Thus, if the vibration system member is displaced from the position of x=0 very slightly, the vibration system member begins to be pulled toward the positive direction of the vibrational displacement x by a force of |Fn−Fs|. Then, after moving to x=xn, |Fn|=|Fs| is satisfied, and the vibration system member becomes stationary since there are no external forces being applied thereon. |FN|=|Fs|=0 is also satisfied at the balancing position (x=0) and there are no external forces being applied on the vibration system member. However, in practice, because of changes that take place due to aging and occurrences of the creep phenomenon in the support system member, x that derives Fs=0 constantly fluctuates. Furthermore, the magnetic attractive force Fn begins to be generated even with a very slight deviation from the balancing position (x=0). Therefore, it is very unlikely that Fn and Fs both become 0 at the balancing position (x=0); thus, in practice, it is unlikely that the vibration system member becomes stationary at the balancing position (x=0). Consequently, when the vibration device 10 is in the non-operating state, the vibration system member becomes stationary in a position deviated from the balancing position by xn where |Fn|=|Fs| is satisfied. As a result, when the vibration device 10 is in the operating state, the vibration system member vibrates having the position of xn as a center.

Figure 4:
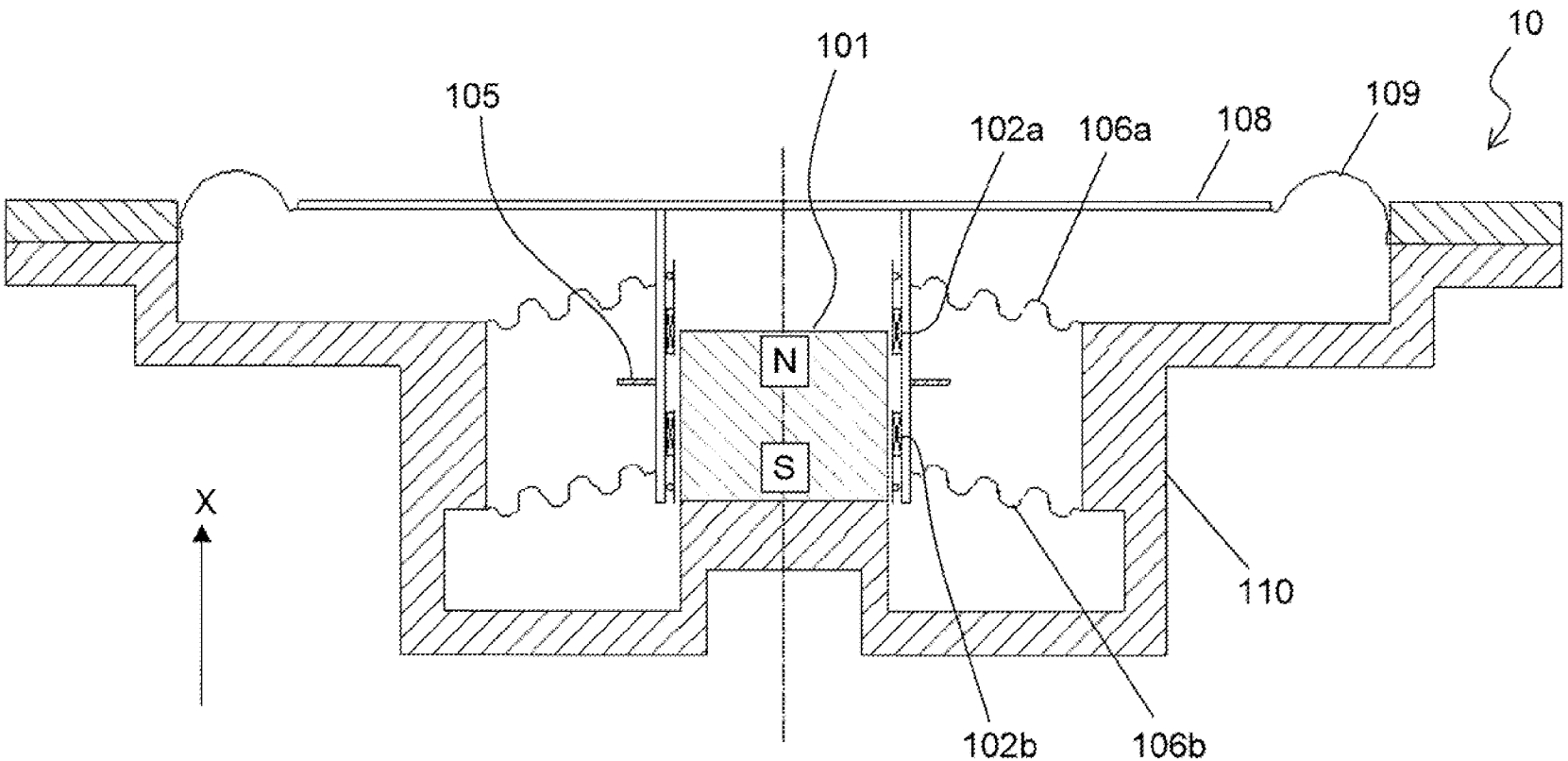
FIG. 4 is a structural profile of the vibration device 10 in a case where a vibration system member is deviated toward xn.

A structural profile of the vibration device 10 when the vibration system member is deviated to xn is shown in FIG. 4. FIG. 4 is the structural profile of the vibration device 10 when the vibration system member is deviated to xn. When the vibration system member is deviated to xn as shown in FIG. 4, a problem arises where a sufficient negative stiffness cannot be obtained.

Figure 31:
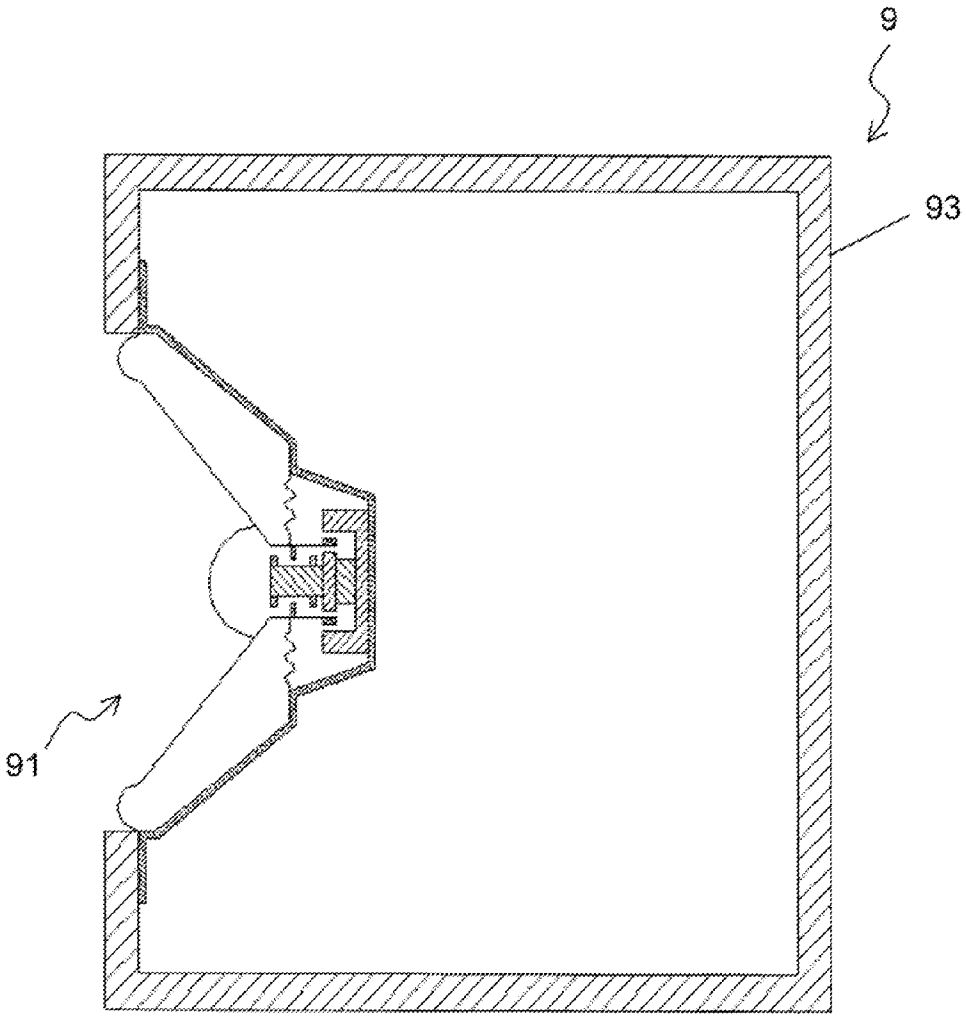
PRIOR ART FIG. 31
FIG. 31 is a figure showing a structure of a sealed-type acoustic system 9 in which the vibration device 91 is applied.

Considered next is a case where the vibration device 10 in FIG. 1 is used in the sealed-type acoustic system 1 shown in FIG. 2. The cabinet 11 is one in which a back surface of the vibration device 10 is sealed. In the above patent document 1, it is described that when a cabinet 93 shown in FIG. 31 is completely sealed, Sms+Smb>Smn is satisfied, and a pole piece 914 does not deviate from a balancing position. Smb is the acoustic stiffness; Sms is the stiffness of the support system in a vibration device 91; and Smn is the negative stiffness of the vibration device 91. However, in practice, leaking of air occurs from an attached part and an edge 916 of the vibration device 91. This also applies to the current embodiment, and in practice, leaking of air occurs from an attached part and the edge 109 of the vibration device 10, and the cabinet 11 does not provide a complete seal. Therefore, the acoustic stiffness of the cabinet 11 becomes smaller when the vibration device 10 is in the non-operating state. Thus, in practice, the relationship of Sms+Smb>Smn is not satisfied, and as described above, the vibration system member becomes stationary in a position deviated by xn as in FIG. 3, when the vibration device 10 is in the non-operating state.

Figure 5:
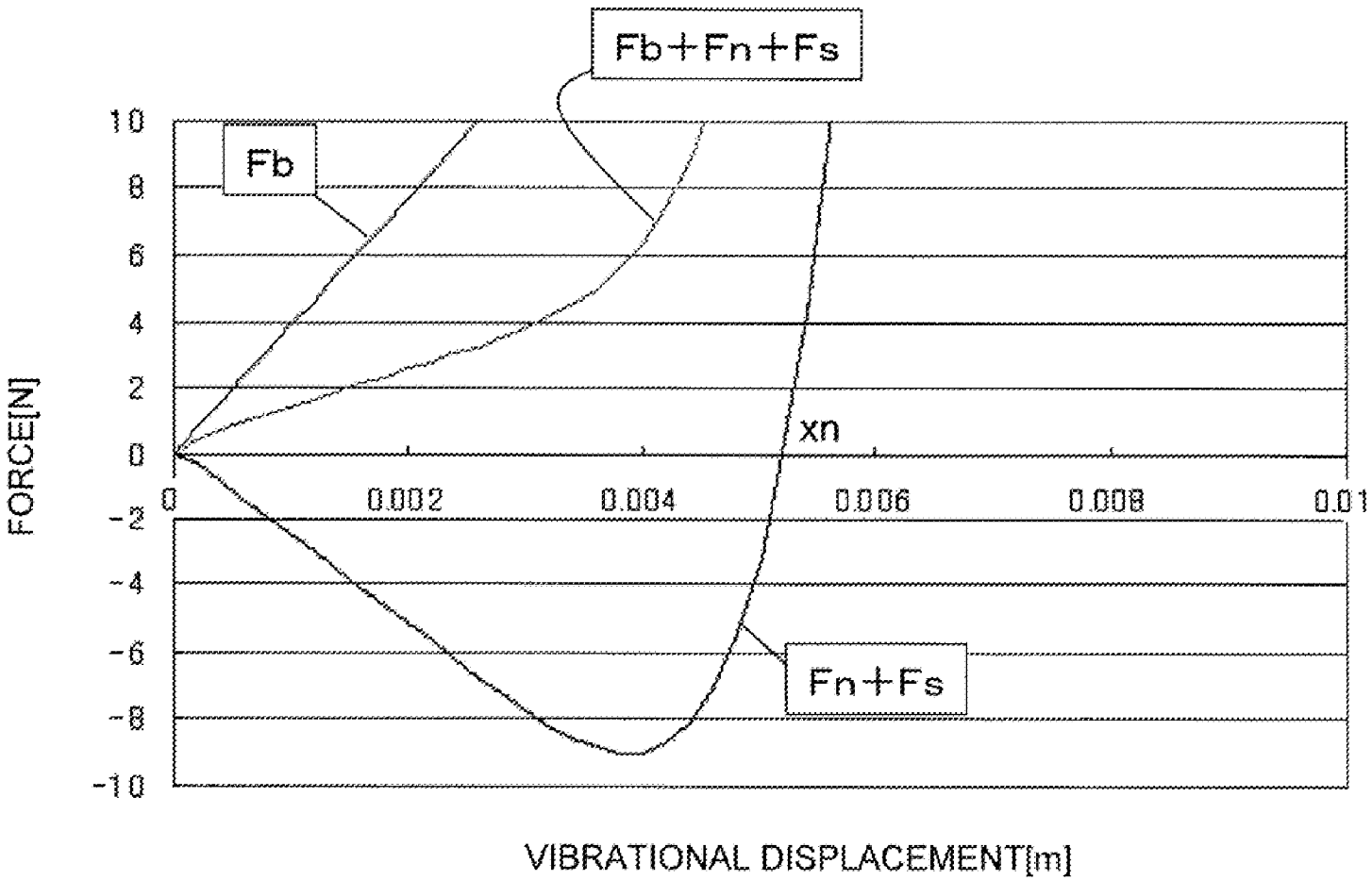
FIG. 5 is a figure showing: a relationship between a force generated by an acoustic stiffness of a cabinet 11 and the vibrational displacement x in the acoustic system 1; and a relationship between the total force generated by the vibration device 10 and the vibrational displacement x.

With reference to FIG. 5, this phenomenon will be described in detail. FIG. 5 is a figure showing: a relationship between a force generated by the acoustic stiffness of the cabinet 11 and the vibrational displacement x in the acoustic system 1; and a relationship between the total force generated by the vibration device 10 and the vibrational displacement x. In FIG. 5, a positive direction of the vibrational displacement x is defined as the positive direction of the X-axis in FIG. 1; and a force that acts in the positive direction of the X-axis is represented as "−", and a force that acts in the X-axis negative direction is represented as "+". Additionally in FIG. 5, a displacement x=0 is the balancing position.

In FIG. 5, the total force generated by the vibration device 10 is Fs+Fn, which is a total of the supporting force Fs and the magnetic attractive force Fn which are shown in FIG. 3. Furthermore, a force Fb, which acts upon the diaphragm 108 of the vibration device 10 and which originates from the acoustic stiffness of the cabinet 11, is proportional to the vibrational displacement x as shown in FIG. 5, when the cabinet 11 is completely sealed. Fb+Fs+Fn, which is a total of Fb and Fs+Fn shown in FIG. 5, has a force lower than Fb, as shown in FIG. 5. However, in practice, it is difficult to completely seal the cabinet 11. Therefore, the actual force Fb generated by the acoustic stiffness becomes almost 0 when the vibration device 10 is in the non-operating state. As a result, when the vibration device 10 is in the non-operating state, the force that acts upon the diaphragm 108 of the vibration device 10 is merely the total force (Fn+Fs) shown in FIG. 5. As described above, because of changes that take place due to aging and occurrences of the creep phenomenon in the support system member, x=0 cannot be obtained, thus, the vibration system member becomes stationary in the position deviated from the balancing position by xn where |Fn|=|Fs| is satisfied. Therefore, the vibration system member vibrates having the position of xn as the center, even when the vibration device 10 is used in the sealed-type acoustic system 1.

As described above, even when the vibration device 10 is used in the sealed-type acoustic system 1, the vibration system member becomes stationary at the position of xn during the non-operating state, and vibrates having the position of xn as a center during the operating state. As a result, a sufficient negative stiffness is not generated at the vibration device 10, and a sufficient capacity expansion effect cannot be obtained in the acoustic system 1. Therefore, in the acoustic system 1, the control section 12 is used for restoring the deviation of the vibration system member to the original balancing position.

First, a case where the vibration device 10 is in the non-operating state is considered. When the detection section 121 is constructed from, for example, the laser displacement meter, a voltage of the displacement signal becomes a voltage that is proportional to the vibrational displacement x. Therefore, in case the vibration system member is stationary at the position of xn, a restoration force that acts to restore to the balancing position is generated by the voice coil 102*a* and by the voice coil 102*b* if the displacement signal detected by the detection section 121 is amplified, inverted, and outputted as the control signal to the voice coil 102*a* and to the voice coil 102*b* which are included in the vibration device 10. As a result of this restoration force, the vibration system member can be restored to the balancing position (x=0) during the non-operating state of the vibration device 10. At the balancing position (x=0), since the voltage of the displacement signal of the detection section 121 becomes 0, the restoration force also becomes 0. On the other hand, if the vibration system member fluctuates even slightly away from the balancing position (x=0), the restoration force proportional to the amount of fluctuation (vibrational displacement) is generated by the voice coil 102*a* and by the voice coil 102*b*. As a result, when the vibration device 10 is in the non-operating state, the position of the vibration system member can be constantly maintained at the balancing position (x=0) by the control section 12. When the vibration device 10 is in the non-operating state and when the vibration system member is in a deviated position, the detection signal of the detection section 121 becomes a direct current. Therefore, it is desired that the amplification section 124 is constructed from a power amplifier which can amplify a direct current.

By referencing FIG. 4 again, the restoration force generated by the voice coil 102*a* and by the voice coil 102*b* will be described. In an example in FIG. 4, the voice coil 102*a* is stationary at a position close to an upper end of the magnet 101 where the magnetic flux density is large. Thus, the voice coil 102*a* is stationary at a position where a strong driving force can be obtained as the restoration force. Therefore, in the case in FIG. 4, the vibration system member can be easily restored to the balancing position by the strong driving force generated by the voice coil 102*a*. In addition, if the vibration system member becomes stationary being deviated downwards (X-axis negative direction) in FIG. 4, the vibration system member can be easily restored to the balancing position by the strong driving force generated by the voice coil 102*b*.

If the voice coil 102*a* becomes stationary at a position upward beyond the upper end of the magnet 101 where the magnetic flux density is small, the strong driving force cannot be obtained by the voice coil 102*a*. However, since the voice coil 102*b* is positioned with the magnetic gap, the strong driving force can be obtained by the voice coil 102*b*. As described here, the vibration device 10 includes two voice coils, the voice coil 102*a* and the voice coil 102*b*. As a result, no matter which position the vibration system member is deviate to, it will be a position within the magnetic gap of either one of the voice coils, thus an effective restoration force can be obtain. Needless to say that the vibration device 10 may include not only two voice coils, the voice coil 102*a* and the voice coil 102*b*, but also three or more voice coils. Furthermore, among the voice coil 102*a* and the voice coil 102*b*, the control section 12 may output the control signal only to either one of the voice coils that can obtain an effective driving force.

Next, considered is a case where the vibration device 10 is in the operating state. When a state is obtained in which the position of the vibration system member in the vibration device 10 is maintained at the balancing position (x=0) by the control section 12, an acoustic signal is being inputted and the vibration device 10 operates as a loudspeaker unit. As shown in FIG. 2, the acoustic signal is inputted into the adder 123. In this case, of course, in order to obtain the capacity expansion effect by the negative stiffness, it is necessary for the vibration system member to vibrate while keeping pace with the acoustic signal without having the position of the vibration system member being fixed at the balancing position (x=0). On the other hand, it is necessary to have the vibration center of the vibration system member to constantly be at the balancing position (x=0).

Here, a positional fluctuation of the vibration center of the vibration system member originates due to an air leak of the cabinet 11, and is a gradual fluctuation. Thus, if represented as a frequency, the positional fluctuation of the vibration center of the vibration system member has a very low frequency which is close to a direct current and which can be distinguished from a frequency of a general acoustic signal (20 Hz to 20 KHz). Therefore, it can be understood that in order to constantly have the vibration center of the vibration system member to be at the balancing position (x=0), outputted to the voice coil 102*a* and the voice coil 102*b* are: the control signal that acts to maintained the balancing position (x=0), if the positional fluctuation has a very low frequency bandwidth which is close to a direct current; and the acoustic signal, if the positional fluctuation has a frequency bandwidth that is higher than the former. Hence, the low pass filter 122 is provided in the control section 12 allowing only the displacement signal having a frequency bandwidth that is close to a direct current to pass through; and outputting, to the voice coil 102*a* and the voice coil 102*b*, the control signal inverted by the phase inversion section 125. With this, the vibration center of the vibration system member can be constantly controlled to be in the balancing position (x=0).

A frequency that is larger than a frequency of the positional fluctuation of the vibration center of the vibration system member can be used as the cut-off frequency of the low pass filter 122. In addition, since a requirement is only to distinguish between the positional fluctuation of the vibration center of the vibration system member and a general acoustic signal, a frequency that is at least lower than the audible range may be configured as the cut-off frequency of the low pass filter 122. Furthermore, a filter characteristic for a frequency bandwidth higher than the cut-off frequency may have a gradual characteristic of −6 dB/oct, or may have a steep characteristic of less than −6 dB/oct. If the cut-off frequency is constant and if the filter characteristic has a steep characteristic, the vibration system member can be vibrated at a lower frequency bandwidth in response to the acoustic signal. As a result, the negative stiffness generated by the vibration can also be exerted at a lower frequency bandwidth. When the filter characteristic has a steep characteristic, it is necessary to consider an influence of a phase rotation against a control system.

As described above, with the acoustic system 1 shown in FIG. 2, the vibration center of the vibration system member can be constantly maintained at the balancing position regardless of the state of the vibration device 10, by including the vibration device 10 and the control section 12. As a result, a sufficient negative stiffness is generated at the vibration device 10, and a sufficient capacity expansion effect can be obtained for the acoustic system 1.

The predefined gain necessary for the amplification section 124 in the control section 12 described above can be obtained as follows. A force coefficient that acts upon the voice coil 102*a* or the voice coil 102*b* is a product B1 obtained by multiplying a magnetic flux density B and a coil length 1. When, the direct current resistance of the voice coil 102*a* or the voice coil 102*b* is defined as Re, and a voltage applied to the voice coil 102*a* or the voice coil 102*b* is defined as Ev: a restoration force Fr can be described by formula (6).

[Formula 6]

$$Fr=B1\times Ev/Re \tag{6}$$

In addition, a total force Fnt (=Fs+Fn) of the vibrational displacement x can be described by formula (7), when a voltage of the displacement signal from the detection section 121 is defined as Vx, the stiffness of the support system is defined as Sins, the negative stiffness by the magnetic attractive force is defined as Smn, and the gain of the detection section 121 is defined as Gx.

[Formula 7]

$$Fnt=(Sms-Smn)\times x=(Sms-Smn)\times Vx/Gx \tag{7}$$

At the control section 12, Ev in formula (6) is obtained by having the output from the detection section 121 being amplified at the amplification section 124. Thus, when the predefined gain necessary for the amplification section 124 is defined as Ga, formula (6) becomes formula (8).

[Formula 8]

$$Fr=B1\times Ga\times Vx/Re \tag{8}$$

Here, if Fr>Fnt is satisfied, a center position of the vibration of the vibration system member can be constantly restored to the balancing position. Therefore, when a condition for the predefined gain Ga necessary for the amplification section 124 is obtain from formula (7) and formula (8), the condition becomes a condition indicated by formula (9).

[Formula 9]

$$Ga>Re\times(Sms-Smn)/B1\times Gx) \tag{9}$$

In FIG. 1, although two dampers, 106*a* and 106*b*, are provided, it is not limited to this configuration. The number of dampers that are provided may be one, or may be three or more.

Figure 6:
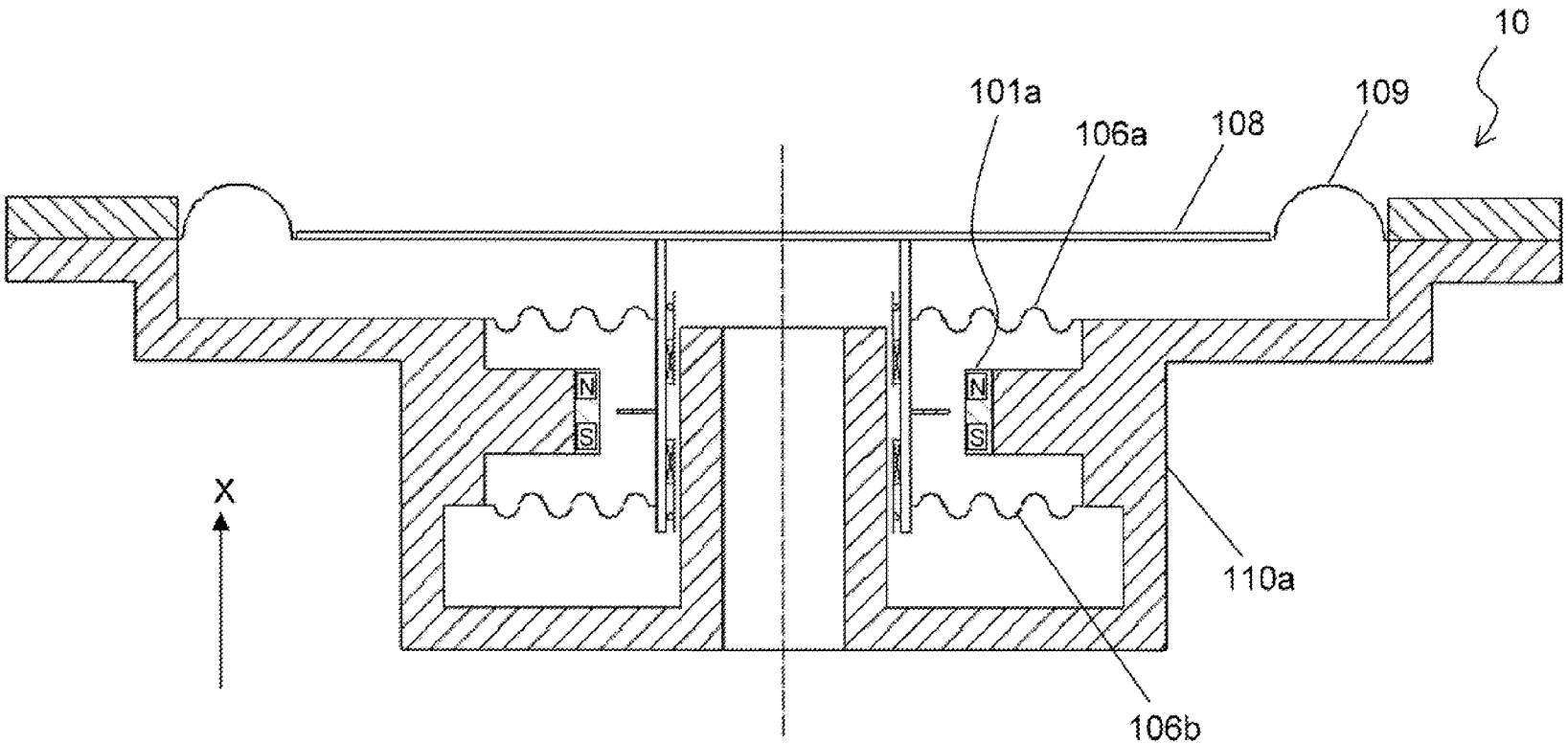
FIG. 6 is a structural profile of the vibration device 10 in which a magnet 101*a* is applied.

Furthermore, in FIG. 1, although the magnet 101 is disposed on the inner circumferential surface sides of the first voice coil bobbin 103*a* and the first voice coil bobbin 103*b*, it is not limited to this configuration. In order to generate the negative stiffness at the vibration device 10, a magnetic flux similar to the magnetic flux A in FIG. 1 is generated. For this, as shown in FIG. 6, instead of the magnet 101, a magnet 101*a* may be disposed on the outer circumferential surface side of the first voice coil bobbin 103*a* and the first voice coil bobbin 103*b*. FIG. 6 is a structural profile of the vibration device 10 in which the magnet 101*a* is applied. Similar to the magnet 101, the magnet 101*a* is polarized in the vibration direction (X-axis direction) of the diaphragm 108. Furthermore, in FIG. 6, the frame 110 is replaced with a frame 110*a*.

Figure 7:
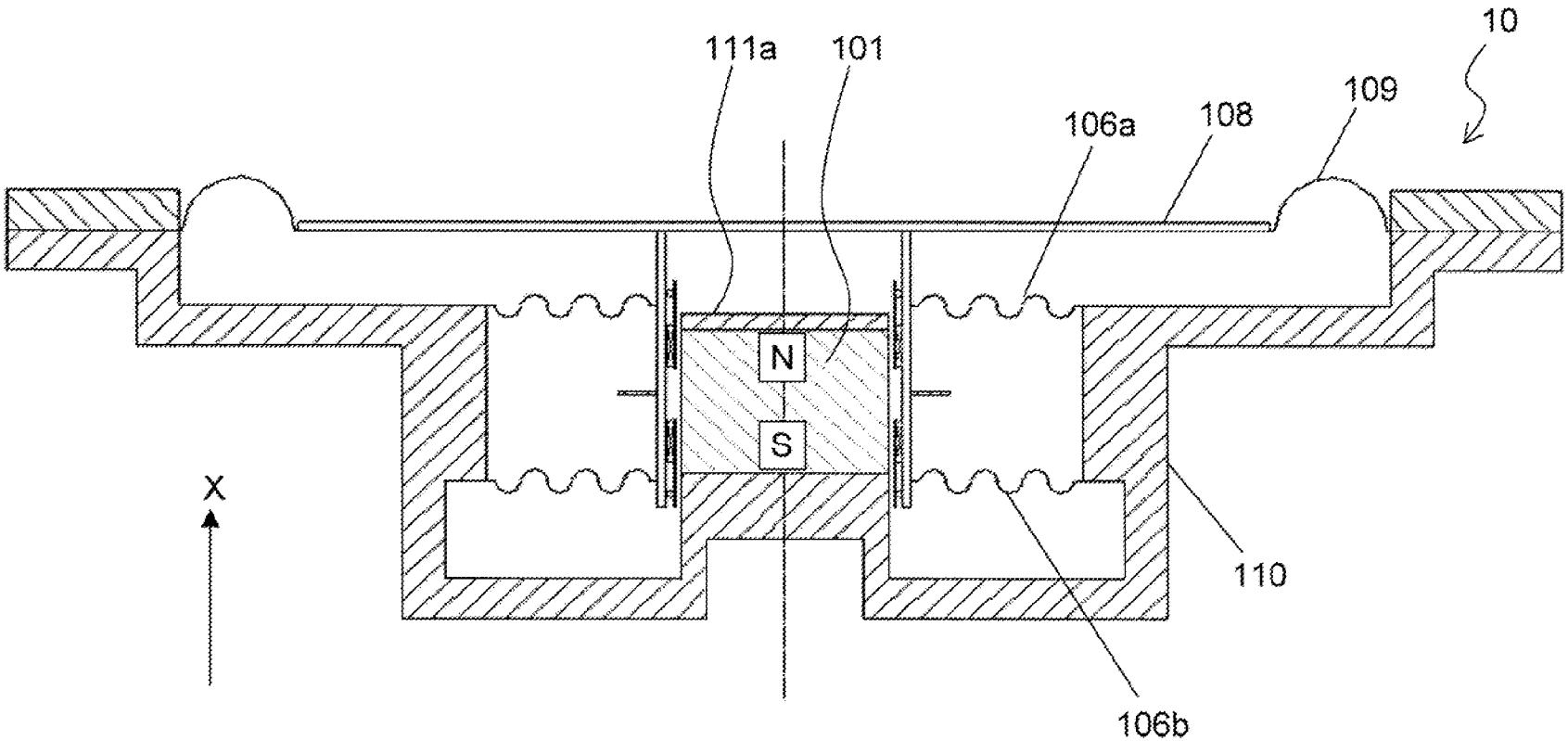
FIG. 7 is a structural profile of the vibration device 10 in a case where a plate 111*a* is fixed only on a magnetic pole surface on the upper side of a magnet 101.
Figure 8:
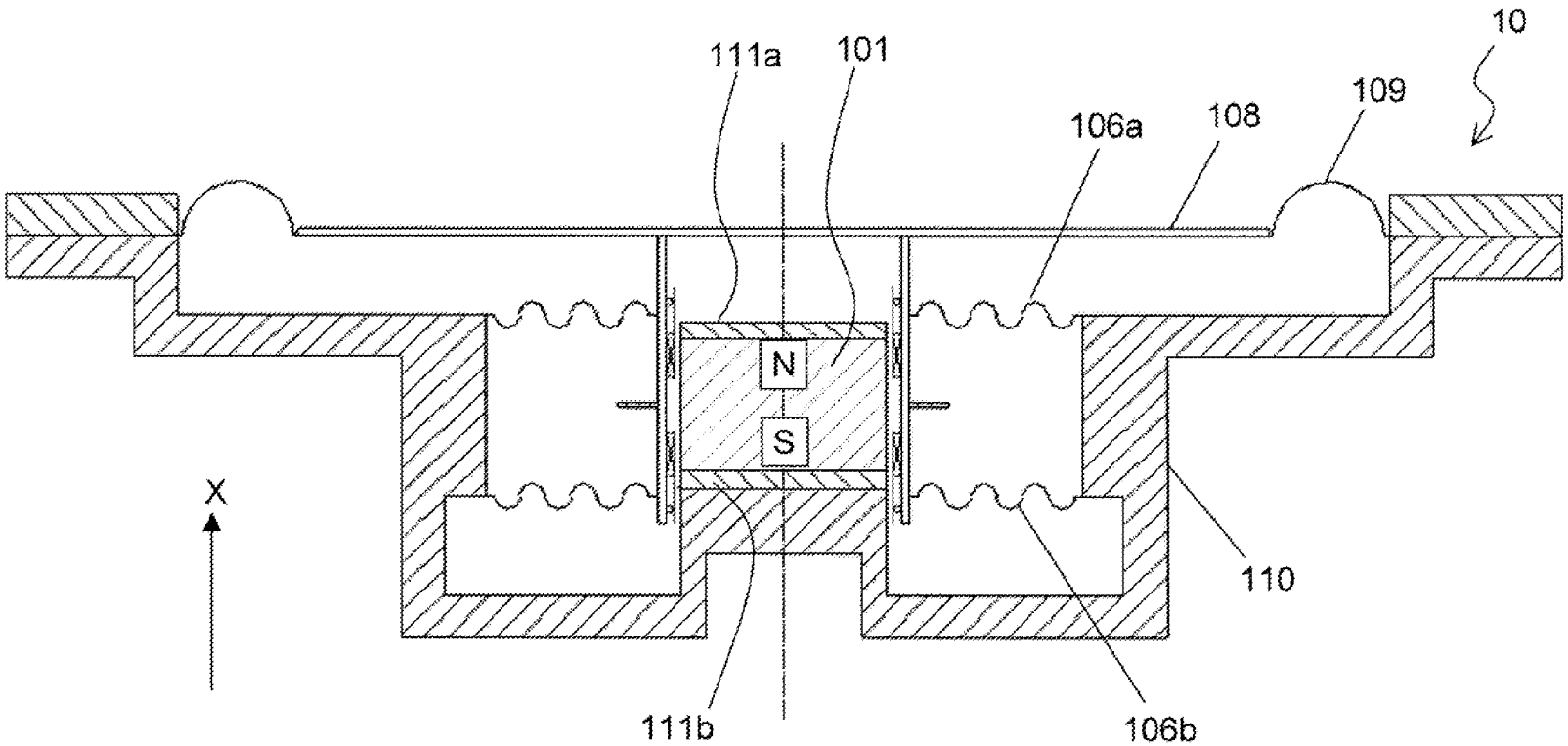
FIG. 8 is a structural profile of the vibration device 10 in a case where the plate 111*a* and a plate 111*b* are respectively fixed on magnetic pole surfaces on the upper and lower sides of the magnet 101.

In addition, as shown in FIG. 7 and FIG. 8, a plate 111*a* and a plate 111*b*, which are iron plates and the like, may be fixed on either one or both the upper and lower sides magnetic pole surfaces of the magnet 101. FIG. 7 is a structural profile of the vibration device 10 in a case where the plate 111*a* is fixed only on the magnetic pole surface on the upper side of the magnet 101. FIG. 8 is a structural profile of the vibration device 10 in a case where the plate 111*a* and the plate 111*b* are respectively fixed on magnetic pole surfaces on the upper and lower sides of the magnet 101. In the cases in FIG. 7 and in FIG. 8, since a magnetic flux density distribution within the magnetic gap changes, a balance between the magnetic attractive force that acts upon the magnetic material member 105 and the restoration force generated by the voice coil 102*a* and the voice coil 102*b* can be adjusted.

(Second Embodiment)

Figure 9:
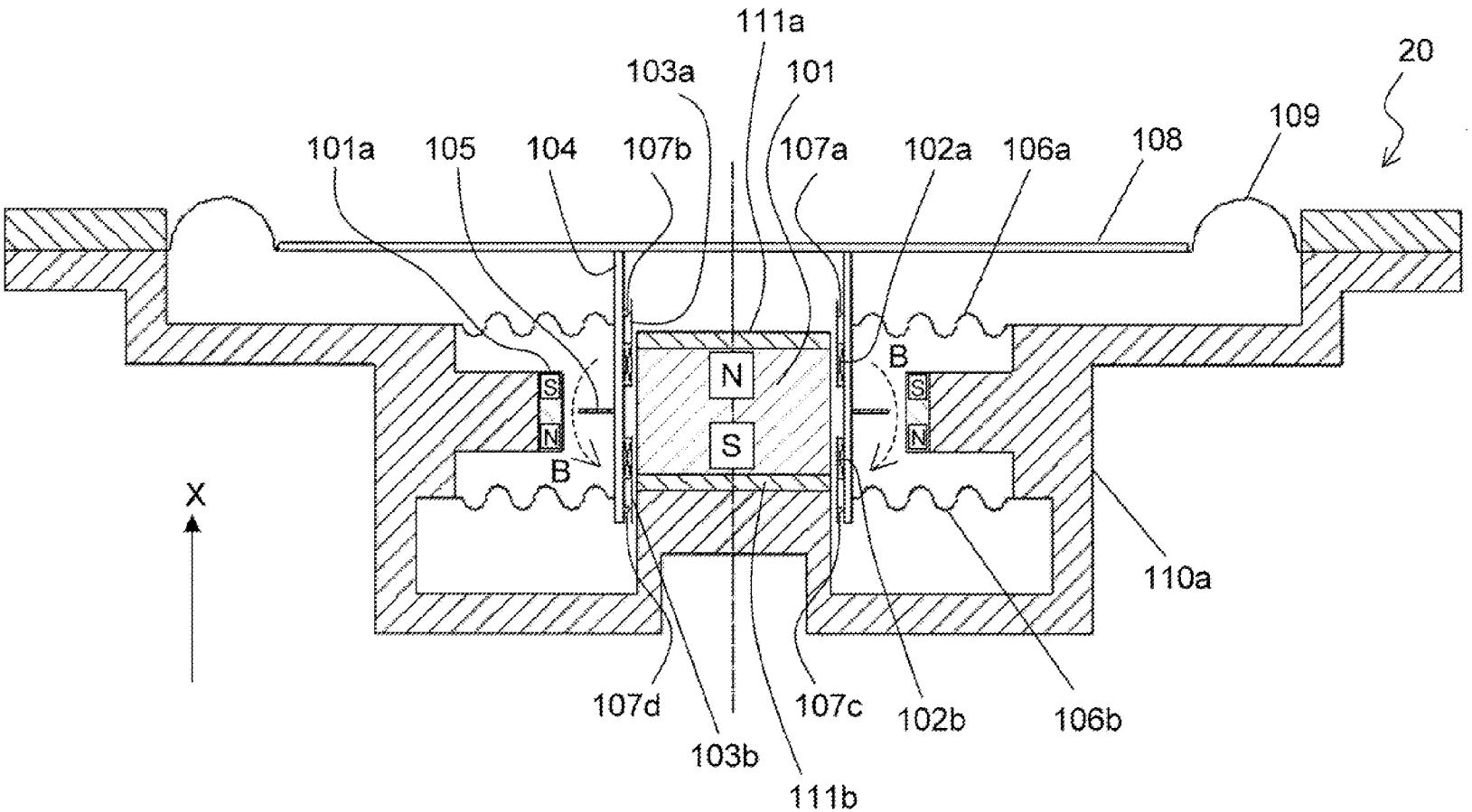
FIG. 9 is a structural profile of a vibration device 20.

With reference to FIG. 9, a vibration device 20 according to a second embodiment will be described. FIG. 9 is a structural profile of the vibration device 20. The vibration device 20 has a structure that is different from the vibration device 10 shown in FIG. 1. Specifically, the vibration device 20 differs from the vibration device 10 by a point that the frame 110 is replaced by the frame 110*a*, and by a point that the plate 111*a*, the plate 111*b*, and the magnet 101*a* are added. Other configurations are similar to those in the vibration device 10, thus identical reference numerals are given and descriptions are omitted. In the following, a description centering on the differing points is provided.

In FIG. 9, the magnet 101*a* is disposed on the outer circumferential surface sides of the first voice coil bobbin 103*a* and the first voice coil bobbin 103*b* by means of the frame 110*a*. In the following, to allow the description to be easily understood the magnet 101 disposed on the inner circumferential surface sides of the first voice coil bobbin 103*a* and the first voice coil bobbin 103*b* is referred to as an inner circumferential surface side magnet 101, and the magnet 101*a* disposed on the outer circumferential surface sides of the first voice coil bobbin 103*a* and the first voice coil bobbin 103*b* is referred to as an outer circumferential surface side magnet 101*a*. The outer circumferential surface side magnet 101*a* is polarized in the vibration direction (X-axis direction); however, the polarization direction is opposite of that of the inner circumferential surface side magnet 101. The plate 111*a*, which is an iron plate and the like, is fixed on the magnetic pole surface (the magnetic pole surface with the N pole) on the upper side of the inner circumferential surface side magnet 101; and the plate 111*b*, which is an iron plate and the like, is fixed on the magnetic pole surface (the magnetic pole surface with the S pole) on the lower side.

Next, an operation of the vibration device 20 shown in FIG. 9 will be described. Since the inner circumferential surface side magnet 101 is polarized in the vibration direction (X-axis direction), the magnet 101 generates a magnetic flux as shown by B in FIG. 9, resulting in a formation of a magnetic gap. This magnetic gap is formed sideward of the inner circumferential surface side magnet 101, that is, a side that faces the second voice coil bobbin 104. Since the outer circumferential surface side magnet 101*a* is polarized in the opposite direction of the inner circumferential surface side magnet 101, the outer circumferential surface side magnet 101*a* acts so as to reinforce the magnetic flux B. The voice coil 102*a* and the voice coil 102*b* are disposed within the magnetic gap. Therefore, when the electrical signal is inputted into the voice coil 102*a* and the voice coil 102*b*, a driving force is generated, and the vibration system member vibrates because of the driving force. The vibration device 10 performs an operation similar to a general loudspeaker unit when an acoustic signal is inputted into the voice coil 102*a* and the voice coil 102*b*.

Furthermore, the magnetic material member 105 is disposed within the magnetic gap. Therefore, when the vibration system member vibrates, the magnetic attractive force by the magnetic flux B acts upon the magnetic material member 105 in a direction away from the balancing position. More specifically, when the magnetic material member 105 is displaced upwards, the magnetic attractive force acts upwards; and when the magnetic material member 105 is displaced downwards, the magnetic attractive force acts downwards. As described here, the magnetic attractive force is a force that acts in a direction that reduces the acoustic stiffness of the cabinet, and is a force referred to as the negative stiffness.

Figure 10:
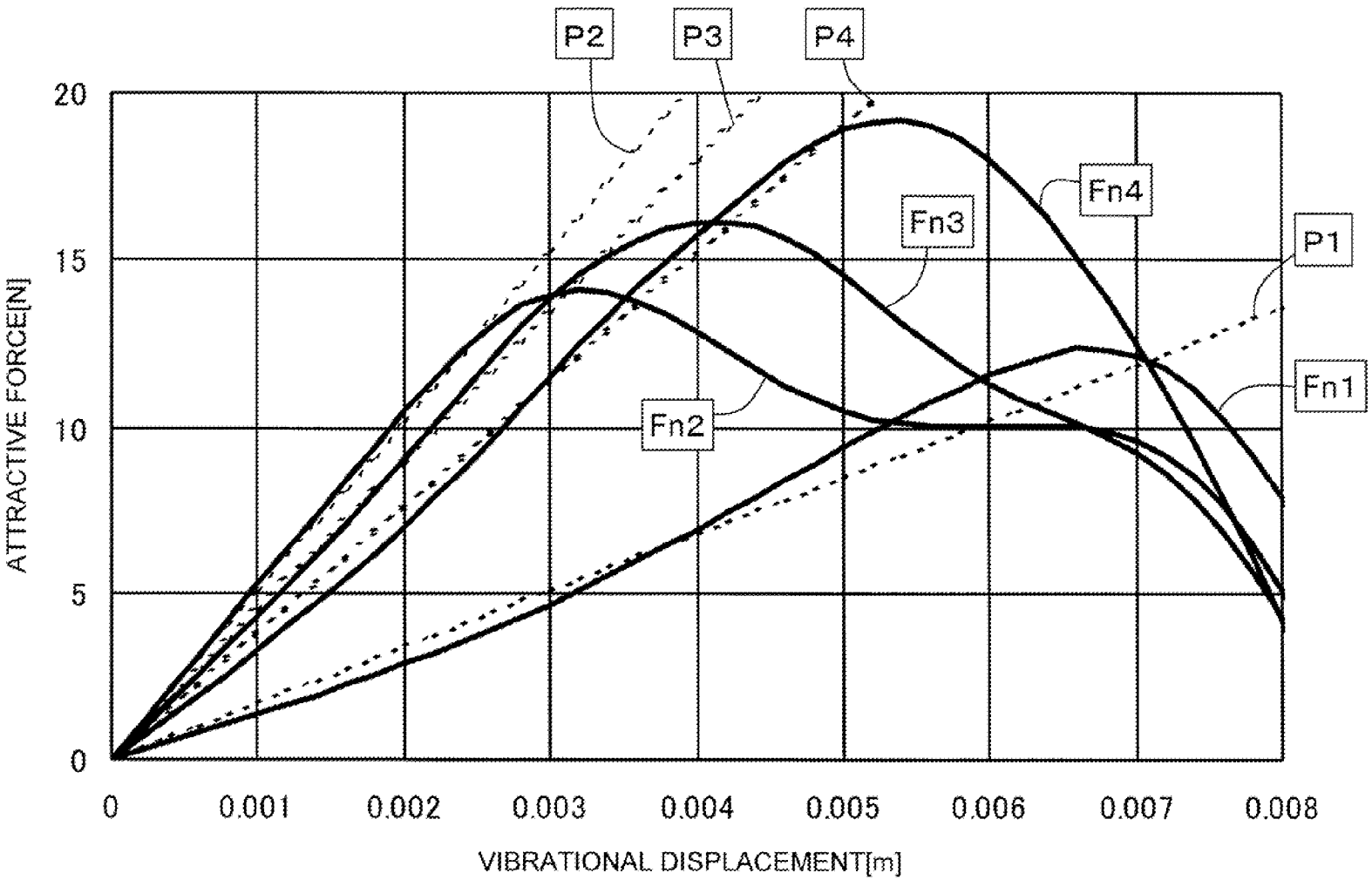
FIG. 10 is a figure showing a characteristic of a magnetic attractive force that acts upon a magnetic material member 105 in a case where a height of an outer circumferential surface side magnet 101*a* (thickness in vibration direction) is altered.

Next, an advantageous effect of a configuration of the vibration device 20 shown in FIG. 9, i.e. an advantageous effect of the current embodiment, will be described with reference to FIG. 10. FIG. 10 is a figure showing a characteristic of the magnetic attractive force that acts upon the magnetic material member 105 in a case where a height of the outer circumferential surface side magnet 101*a* (thickness in vibration direction) is altered. A horizontal axis in FIG. 10 shows the vibrational displacement x, and the positive direction of the vibrational displacement x is defined as the positive direction of the X-axis shown in FIG. 9. A vertical axis in FIG. 10 shows the magnetic attractive force, and the magnetic attractive force that acts in the positive direction of the X-axis is represented as "+".

In FIG. 10, a characteristic Fn1 shows a characteristic of the magnetic attractive force when the outer circumferential surface magnet 101*a* is not provided. A characteristic Fn2, a characteristic Fn3, and a characteristic Fn4 are characteristics of the magnetic attractive force when the outer circumferential surface magnet 101*a* is provided; and the height of the outer circumferential surface magnet 101*a* becomes higher in sequence from the characteristic Fn2 to the characteristic Fn4. Among these, the characteristic Fn2 shows a characteristic of a case where the height of the outer circumferential surface magnet 101*a* is a height shown in FIG. 9; and the characteristic Fn4 shows a characteristic of a case where the height of the outer circumferential surface magnet 101*a* is a height of the inner circumferential surface side magnet 101 (thickness in vibration direction). A characteristic P1 is a characteristic obtained by linearizing the characteristic Fn1 by using an inclination that is closest to an inclination of the characteristic Fn1. A characteristic P2 is a characteristic obtained by linearizing the characteristic Fn2 by using an inclination that is closes to an inclination of the characteristic Fn2. A characteristic P3 is a characteristic obtained by linearizing the characteristic Fn3 by using an inclination that is closest to an inclination of the characteristic Fn3. A characteristic P4 is a characteristic obtained by linearizing the characteristic Fn4 by using an inclination that is closes to an inclination of the characteristic Fn4. Looking at a degree of separation between the characteristic Fn1 and the characteristic P1 allows to understand that the vibrational displacement x has a high linearity in a range where the characteristic Fn1 and the characteristic P1 are not separated. The same can be said for: the characteristic Fn2 and the characteristic P2, the characteristic Fn3 and the characteristic P3, and the characteristic Fn4 and the characteristic P4.

In FIG. 10, when the degree of separation between the characteristic Fn1 and the characteristic P1 is compared to the degree of separation between the characteristic Fn2 to characteristic Fn4 and the characteristic P2 to characteristic P4, the characteristic Fn2 to characteristic Fn4 have a smaller degree of separation from the characteristic P2 to characteristic P4. Thus, it can be understood that the linearity of the magnetic attractive force improves when the outer circumferential surface magnet 101*a* is provided. Furthermore, the capacity expansion effect that can be obtained is small with the characteristic Fn1 when the outer circumferential surface magnet 101*a* is not provided; since the inclination is small and the magnetic attractive force is small. On the other hand, with the characteristic Fn2 to characteristic Fn4 when the outer circumferential surface magnet 101*a* is provided, since the inclination is large within a range where the vibrational displacement x is small and the magnetic attractive force is large, the capacity expansion effect that can be obtained is also large. In addition, it can be understood by observing the characteristic Fn1 to characteristic Fn4 that, if the vibrational displacement x becomes larger than a certain degree, the magnetic attractive force becomes smaller. Furthermore, it can be understood from the characteristic Fn1 to characteristic Fn4 that, a characteristic of the magnetic attractive force can be controlled freely by adding the outer circumferential surface side magnet 101*a* or changing the thickness of the added outer circumferential surface side magnet 101*a*.

In FIG. 10, the characteristic Fn2 shows the characteristic of the case where the height of the outer circumferential surface magnet 101*a* is the height shown in FIG. 9; and the characteristic Fn4 shows the characteristic of the case where the height of the outer circumferential surface magnet 101*a* is the height of the inner circumferential surface side magnet 101 (thickness in vibration direction). Here, it can be understood that the characteristic Fn2 has a superior linearity within a range of the vibrational displacement x up until the magnetic attractive force becomes maximum, when the degree of separation between the characteristic P2 and the characteristic Fn2 is compared to the degree of separation between the characteristic P4 and the characteristic Fn4. From this, it can be understood that reducing the height of the outer circumferential surface side magnet 101*a* is effective in improving the linearity. Additionally, it can be understood that, reducing the height of the outer circumferential surface side magnet 101*a* allows obtaining a large magnetic attractive force when the vibrational amplitude is small (i.e. the vibrational displacement x is small), and enlarges the capacity expansion effect that can be obtained.

Figure 11:
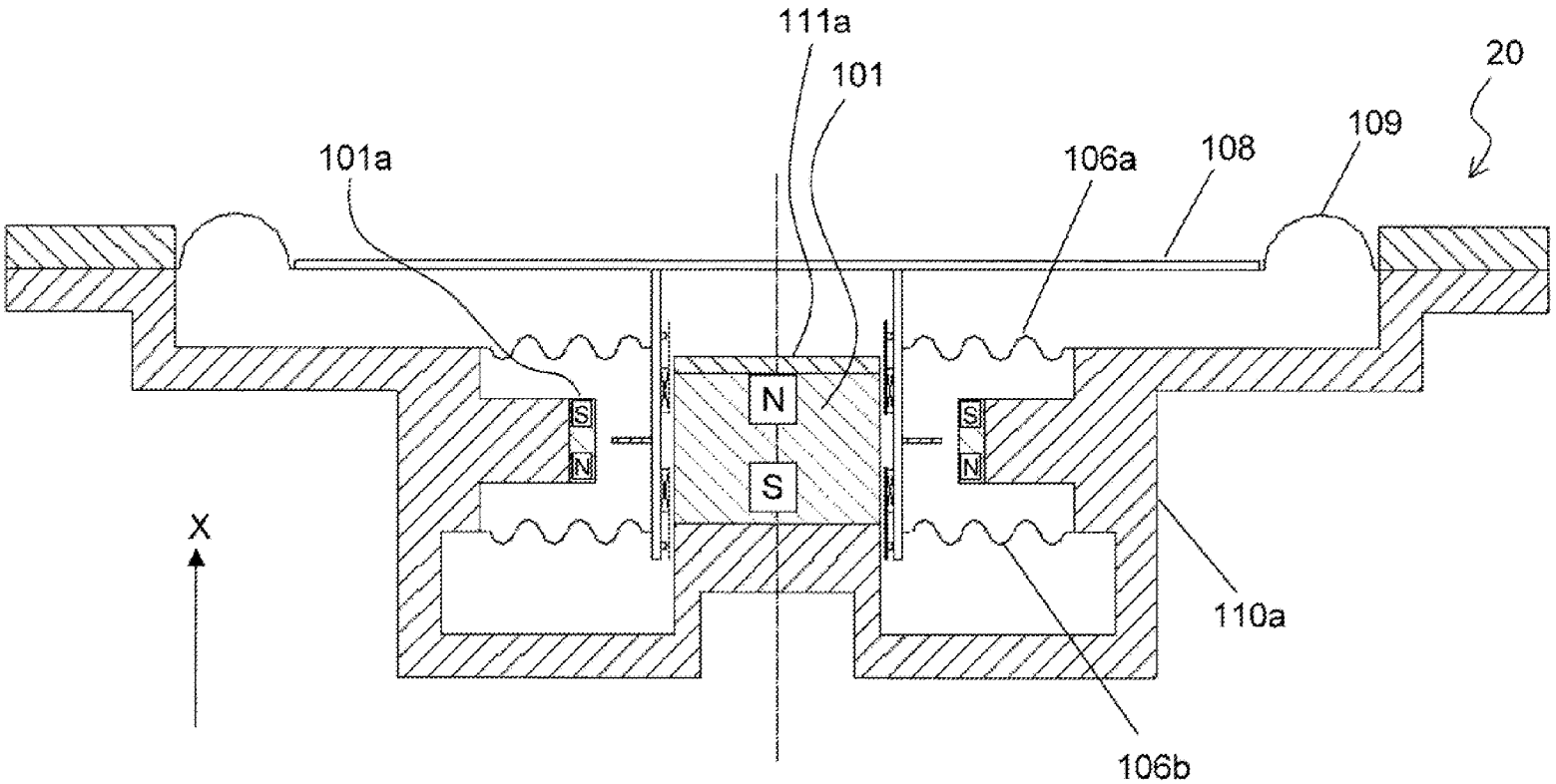
FIG. 11 is a structural profile of the vibration device 20 in a case where the plate 111*a* is fixed only on a magnetic pole surface on the upper side of an inner circumferential surface side magnet 101.
Figure 12:
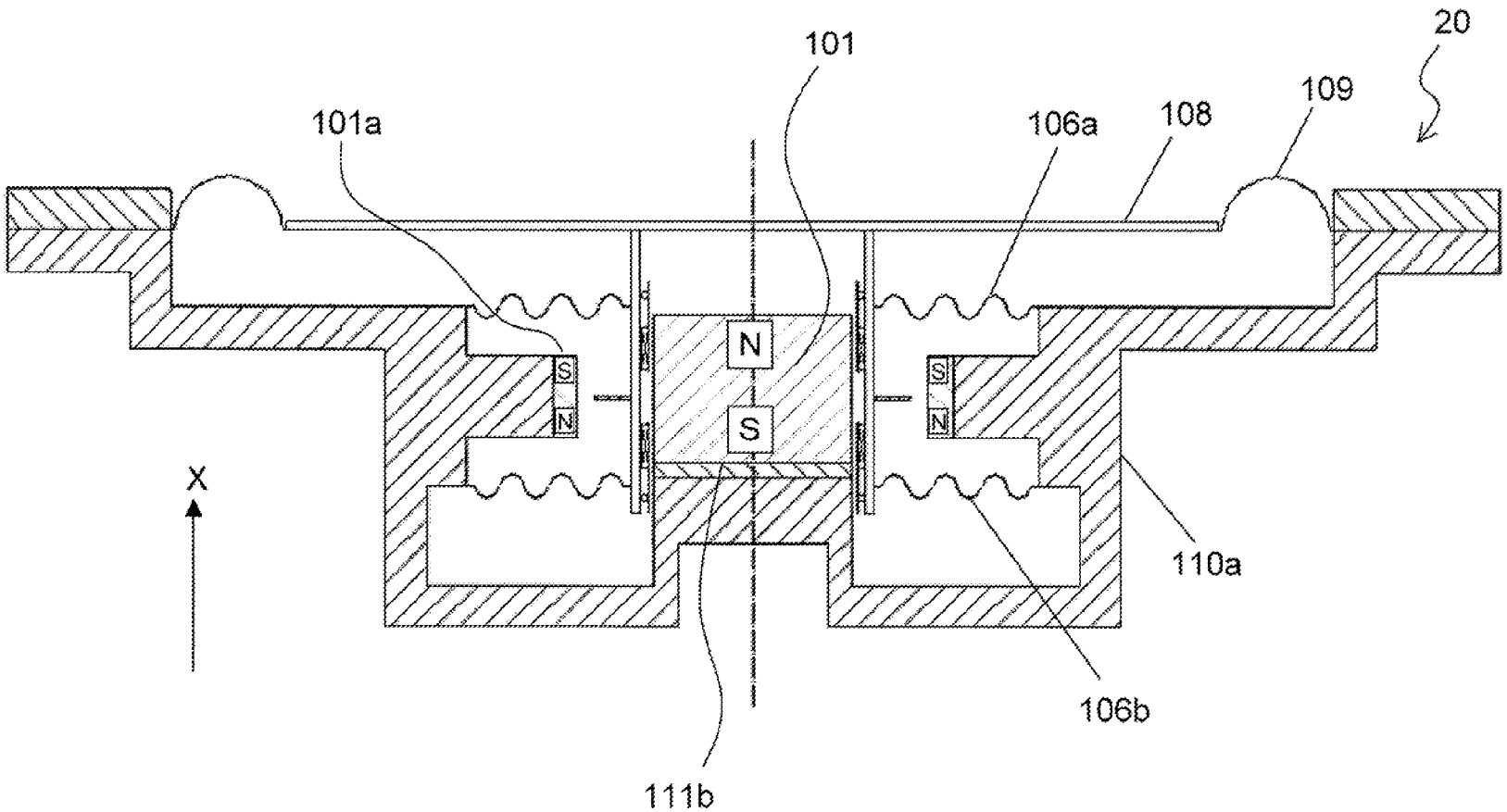
FIG. 12 is a structural profile of the vibration device 20 in a case where the plate 111*b* is fixed only on a magnetic pole surface on the lower side of the inner circumferential surface side magnet 101.
Figure 13:
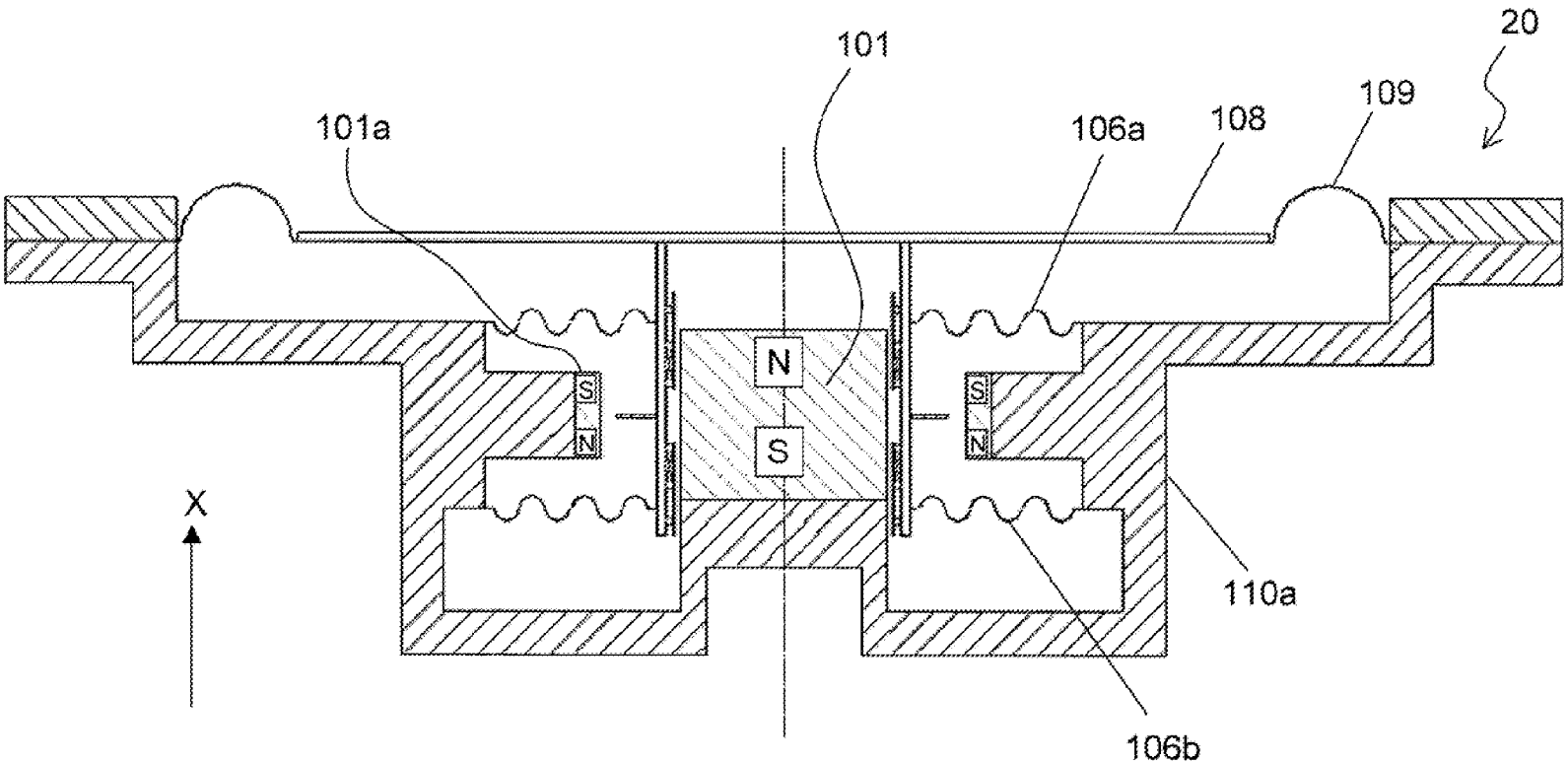
FIG. 13 is a structural profile of the vibration device 20 in a case where neither the plate 111*a* nor the plate 111*b* are fixed on the magnetic pole surfaces on the upper and lower sides of the inner circumferential surface side magnet 101.

In FIG. 9, although the plate 111*a* and the plate 111*b* are respectively fixed on the magnetic pole surfaces on the upper and lower sides of the inner circumferential surface side magnet 101, it is not limited to this configuration. As shown in FIG. 11 and FIG. 12, the plate 111*a* and the plate 111*b*, which are iron plates and the like, may be fixed on either one side of the magnetic pole surfaces on the upper and lower sides on the inner circumferential surface side magnet 101. FIG. 11 is a structural profile of the vibration device 20 in a case where the plate 111*a* is fixed only on a magnetic pole surface on the upper side of the inner circumferential surface side magnet 101. FIG. 12 is a structural profile of the vibration device 20 in a case where the plate 111*b* is fixed only on a magnetic pole surface on the lower side of the inner circumferential surface side magnet 101. Furthermore, as shown in FIG. 13, the plate 111*a* and the plate 111*b* can be absent. FIG. 13 is a structural profile of the vibration device 20 in a case where neither the plate 111*a* nor the plate 111*b* are fixed on the magnetic pole surfaces on the upper and lower sides of the inner circumferential surface side magnet 101.

Figure 14:
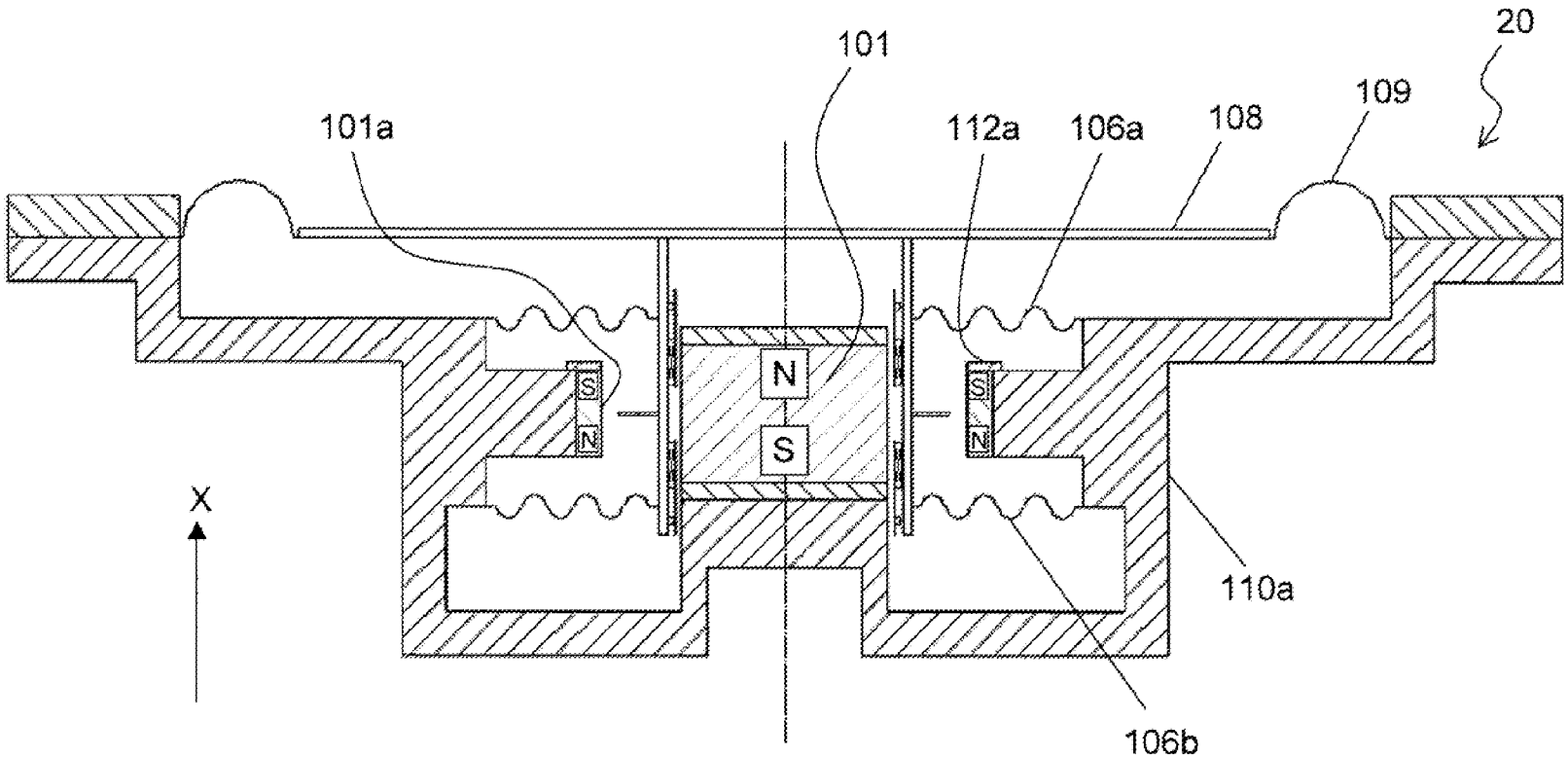
FIG. 14 is a structural profile of the vibration device 20 in a case where a plate 112*a* is fixed only on a magnetic pole surface on the upper side of an outer circumferential surface side magnet 101*a*.
Figure 15:
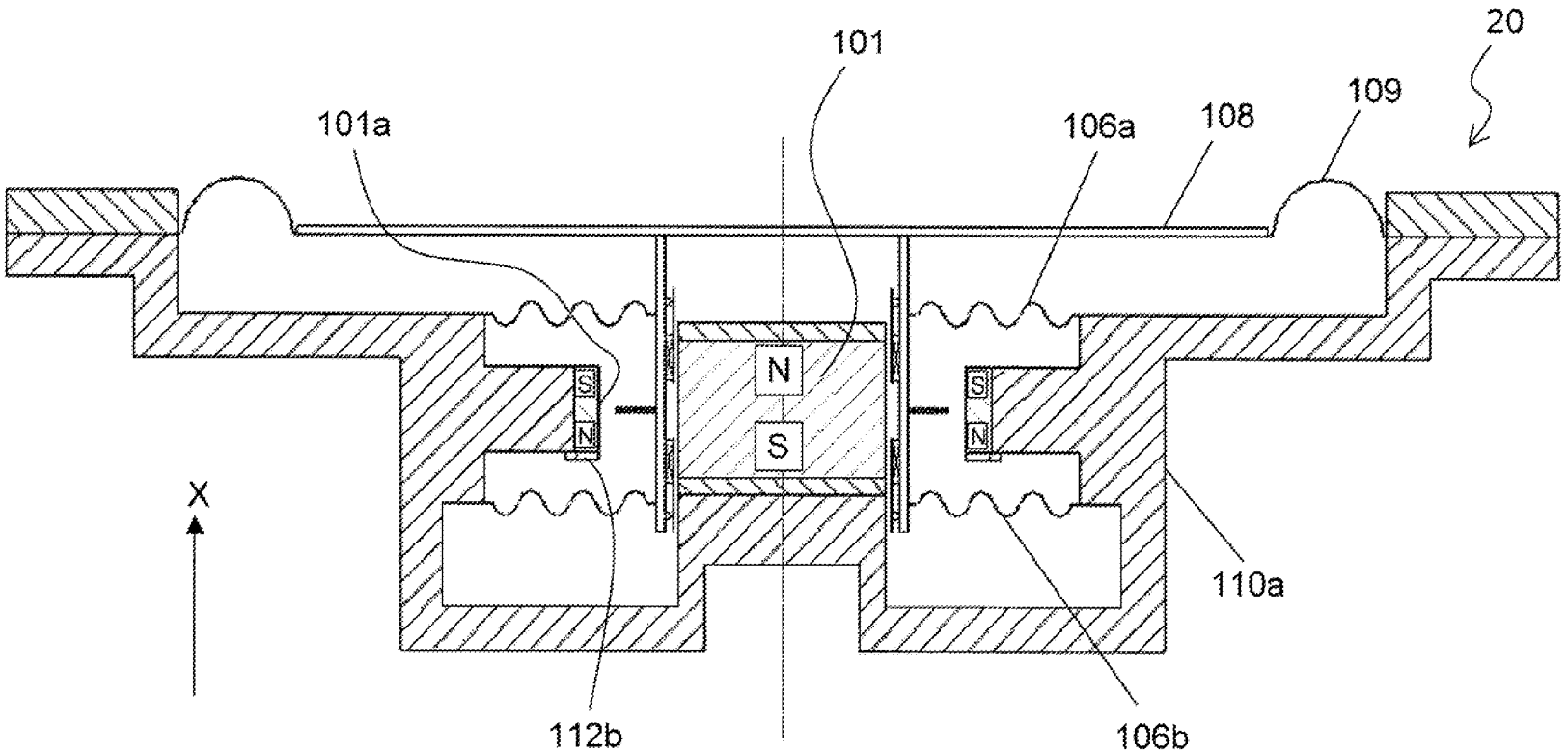
FIG. 15 is a structural profile of the vibration device 20 in a case where a plate 112*b* is fixed only on a magnetic pole surface on the lower side of the outer circumferential surface side magnet 101*a*.
Figure 16:
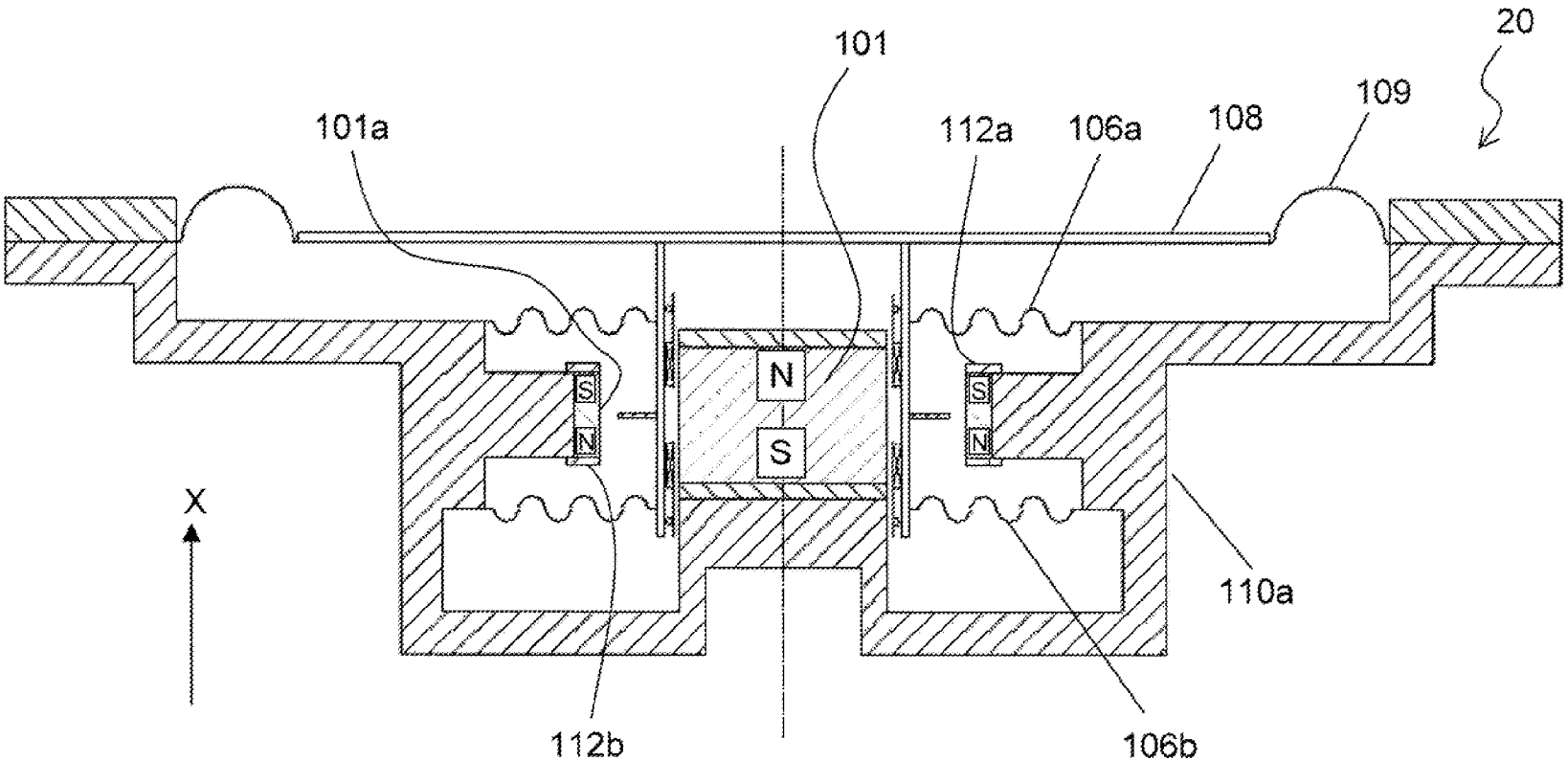
FIG. 16 is a structural profile of the vibration device 20 in a case where the plate 112*a* and the plate 112*b* are respectively fixed on magnetic pole surfaces on the upper and lower sides of the outer circumferential surface side magnet 101*a*.

As shown in FIG. 14 to FIG. 16, a plate 112*a* and a plate 112*b*, which are iron plates and the like, may be fixed on either one or both magnetic pole surfaces on the upper and lower sides of the outer circumferential surface side magnet 101*a*. FIG. 14 is a structural profile of the vibration device 20 in a case where the plate 112*a* is fixed only on the magnetic pole surface on the upper side of the outer circumferential surface side magnet 101*a*. FIG. 15 is a structural profile of the vibration device 20 in a case where the plate 112*b* is fixed only on the magnetic pole surface on the lower side of the outer circumferential surface side magnet 101*a*. FIG. 16 is a structural profile of the vibration device 20 in a case where the plate 112*a* and the plate 112*b* are respectively fixed on the magnetic pole surfaces on the upper and lower sides of the outer circumferential surface side magnet 101*a*. Since the magnetic flux density distribution within the magnetic gap changes by fixing the plate 112*a* and the plate 112*b*, a balance between the magnetic attractive force that acts upon the magnetic material member 105 and the restoration force generated by the voice coil 102*a* and the voice coil 102*b* can be adjusted.

Figure 17:
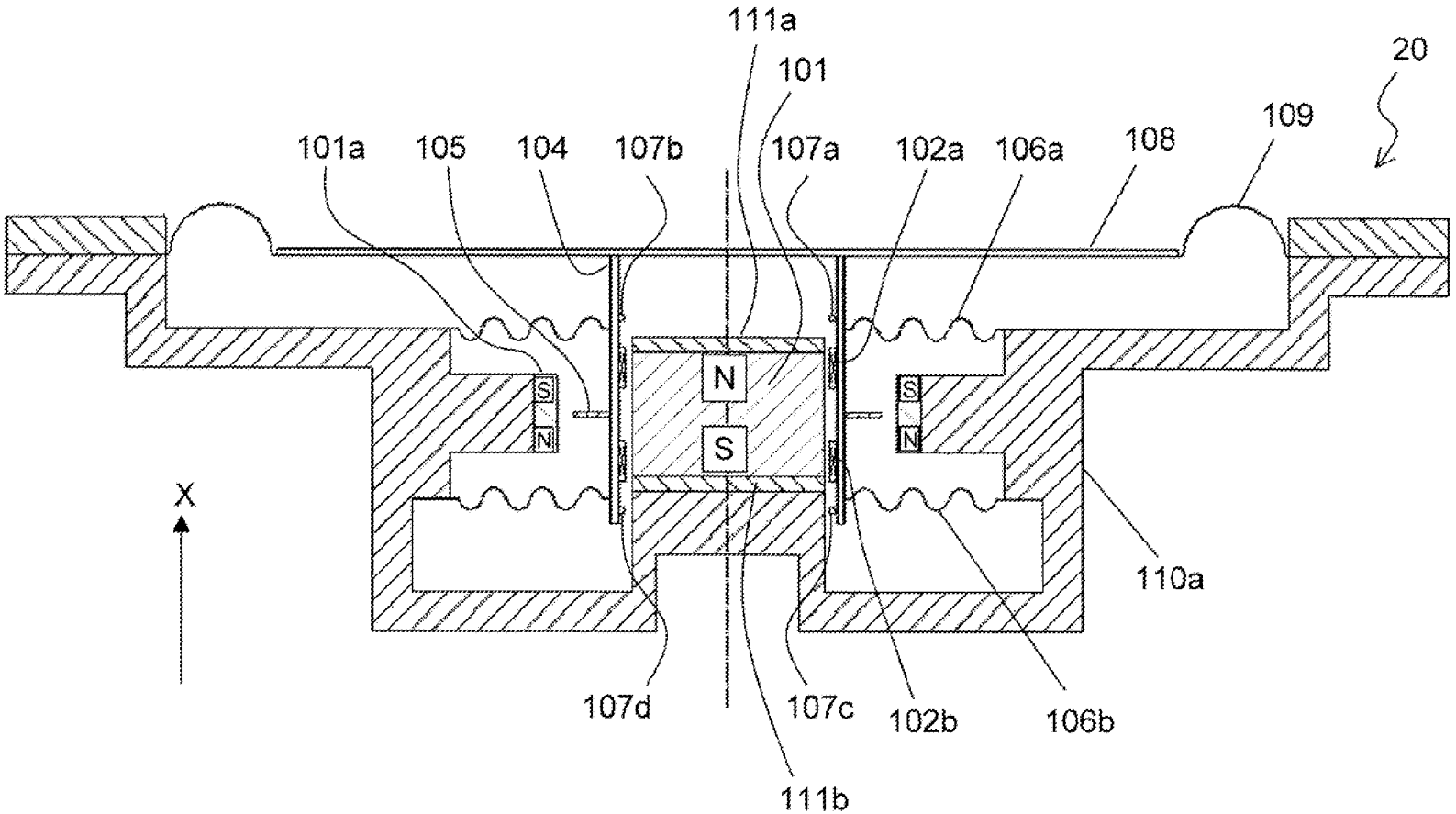
FIG. 17 is a structural profile of the vibration device 20 in a case where a first voice coil bobbin 103*a* and a first voice coil bobbin 103*b* are omitted.

Furthermore, although the first voice coil bobbin 103*a* and the first voice coil bobbin 103*b* are provided in FIG. 9, they may be omitted as shown in FIG. 17. FIG. 17 is a structural profile of the vibration device 20 in a case where the first voice coil bobbin 103*a* and the first voice coil bobbin 103*b* are omitted. By adopting the structure shown in FIG. 17, the weight of the vibration system member can be reduced. The first voice coil bobbin 103*a* and the first voice coil bobbin 103*b* may also be omitted from the vibration device 10 according to the first embodiment shown in FIG. 1.

Figure 18:
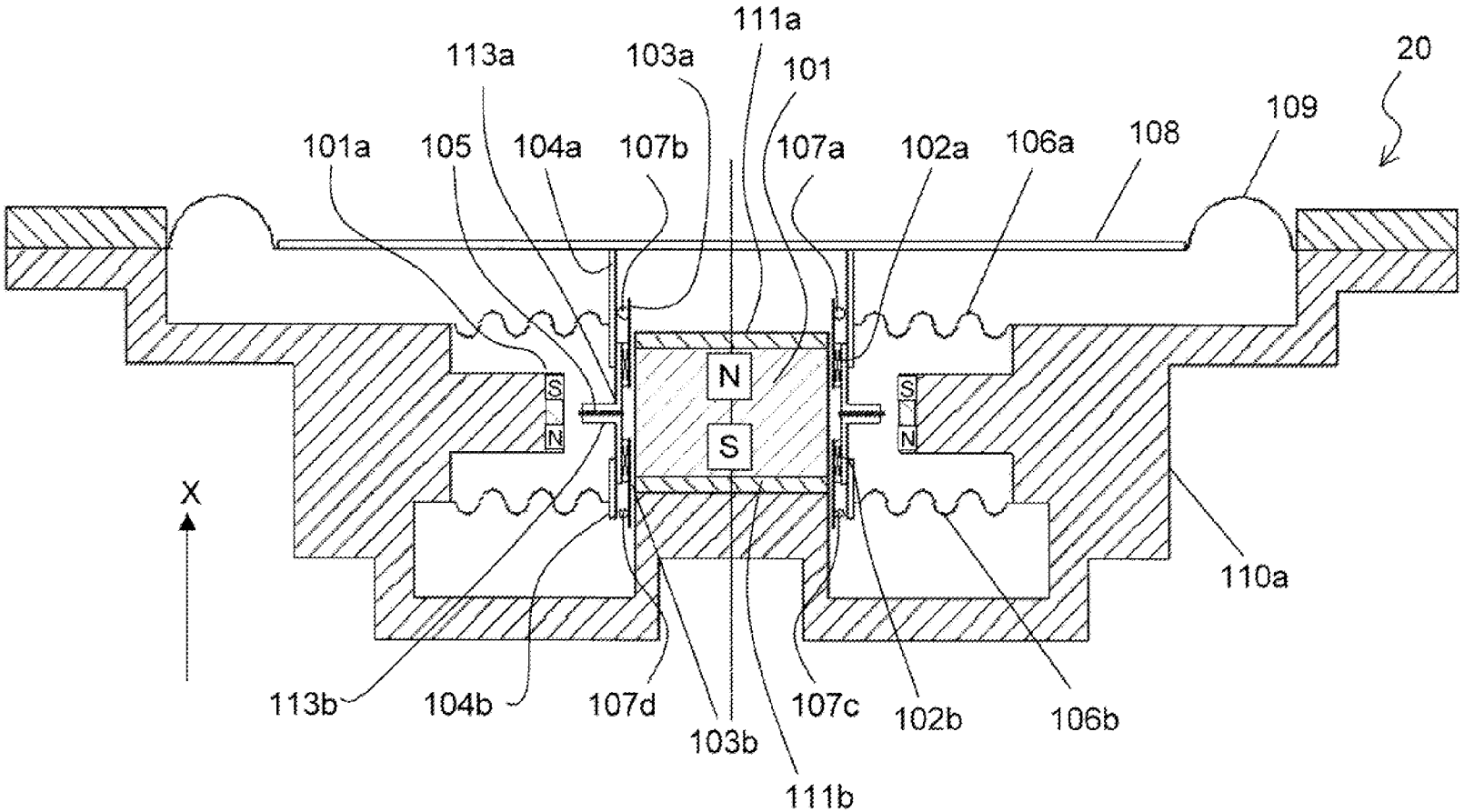
FIG. 18 is a structural profile of the vibration device 20 in a case where a second voice coil bobbin 104*a* and a second voice coil bobbin 104*b* are provided as a result of a dividing one voice coil bobbin into two voice coil bobbins.

Furthermore, the second voice coil bobbin 104 shown in FIG. 9 may be divided into the second voice coil bobbin 104*a* and the second voice coil bobbin 104*b* as shown in FIG. 18. FIG. 18 is a structural profile of the vibration device 20 in a case where the second voice coil bobbin 104*a* and the second voice coil bobbin 104*b* are provided as a result of the division. In this case, the vibration device 20 further includes a support member 113*a* and a support member 113*b*. The outer circumferential surface of the second voice coil bobbin 104*a* is fixed on the inner circumferential surface of the damper 106*a*; and the outer circumferential surface of the second voice coil bobbin 104*b* is fixed on the inner circumferential surface of the damper 106*b*. A lower portion of the second voice coil bobbin 104*a* is fixed on the support member 113*a*; and an upper portion of the second voice coil bobbin 104*b* is fixed on the support member 113*b*. The first voice coil bobbin 103*a* is provided on an inner circumferential surface side of the support member 113*a*; and the voice coil 102*a* is provided on the outer circumferential surface of the first voice coil bobbin 103*a*. The first voice coil bobbin 103*b* is provided on an inner circumferential surface side of the support member 113*b*; and the voice coil 102*b* is provided on the outer circumferential surface of the first voice coil bobbin 103*b*. The magnetic material member 105 is interposed between the support member 113*a* and the support member 113*b* at the balancing position within the magnetic gap. By adopting this structure, a degree of freedom increases in designing: a method for applying current to the voice coil 102*a* and to the voice coil 102*b*; and the size of the magnetic material member 105. The second voice coil bobbin 104 may be divided into the second voice coil bobbin 104*a* and the voice coil bobbin 104*b* as shown in FIG. 18 also in the case with the vibration device 10 according to the first embodiment shown in FIG. 1.

(Third Embodiment)

Figure 19:
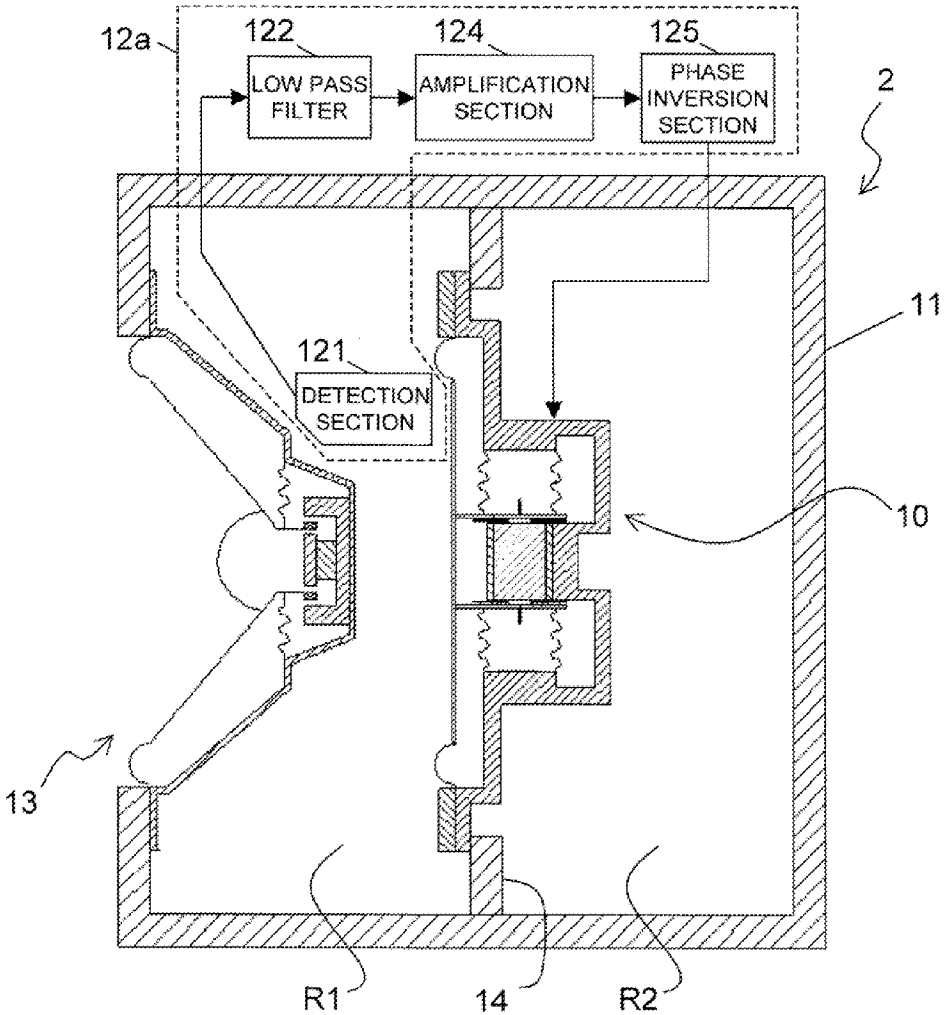
FIG. 19 is a structural profile of an acoustic system 2.

With reference to FIG. 19, an acoustic system 2 according to a third embodiment will be described. FIG. 19 is a structural profile of the acoustic system 2 according to the third embodiment. In an example in FIG. 19, a sealed-type loudspeaker system is adopted as the acoustic system. In FIG. 19, the acoustic system 2 includes: the vibration device 10; the cabinet 11; a control section 12*a*; a loudspeaker unit 13; and a partition plate 14. The different point between the acoustic system 2 and the acoustic system 1 shown in FIG. 1 is a point that the vibration device 10 is applied only for generating the negative stiffness. Specifically, the acoustic system 2 differs from the acoustic system 1 shown in FIG. 1 by a point that the control section 12 is replaced with the control section 12*a*, and by a point that the loudspeaker unit 13 and the partition plate 14 are further included. Other configurations are similar to those in the acoustic system 1, thus identical reference numerals are given and descriptions are omitted. In the following, a description centering on the differing points is provided.

The loudspeaker unit 13 is, for example, an electrodynamic loudspeaker attached to the cabinet 11. An acoustic signal such as an audio signal is inputted into the loudspeaker unit 13, and a sound in accordance with the acoustic signal is generated. The partition plate 14 is attached inside the cabinet 11 so as to divide the inside of the cabinet 11 into a first cavity R1 and a second cavity R2. The vibration device 10 is attached to the partition plate 14. The control section 12*a* includes: the detection section 121; the low pass filter 122; the amplification section 124; and the phase inversion section 125. The control section 12*a* differs from the control section 12 shown in FIG. 1 only by a point that the adder 123 is omitted. Other configurations are similar to those in the control section 12, thus identical reference numerals are given and descriptions are omitted.

An operation of the acoustic system 2 configured as above will be described. When the acoustic signal is inputted into the loudspeaker unit 13, the diaphragm of the loudspeaker unit 13 vibrates, and a sound in accordance with the acoustic signal is generated. This sound vibrates the diaphragm 108 of the vibration device 10 via the first cavity R1. As described in the first embodiment, the negative stiffness is generated in response to the vibrational displacement of the diaphragm 108. Furthermore, although the adder 123 is absent, as described in the first embodiment, the control section 12*a* controls the vibration of the vibration device 10 so as to constantly maintain the vibration center of the vibration system member in the balancing position.

Figure 20:
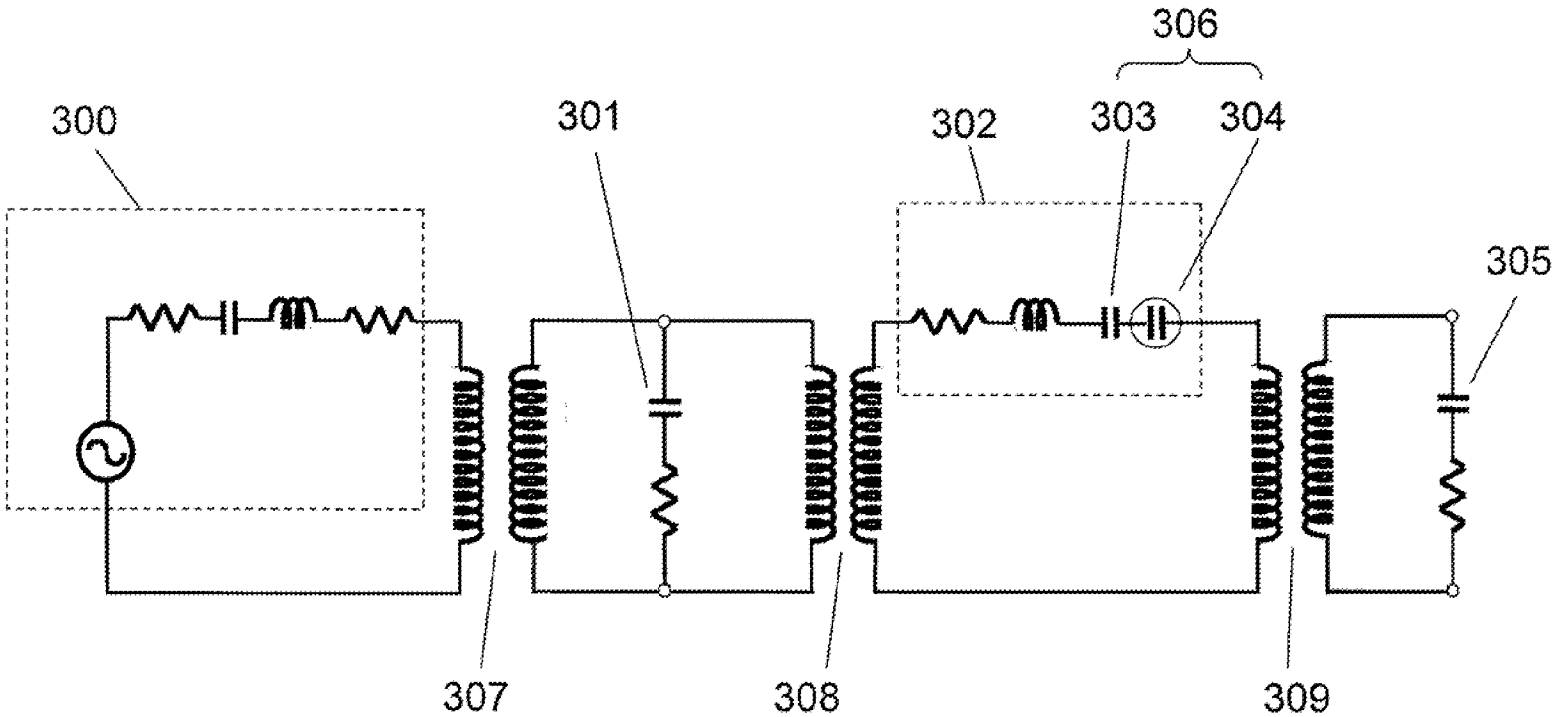
FIG. 20 is a figure showing a mechanical equivalent circuit of the acoustic system 2 shown in FIG. 19.

Here, if the acoustic system 2 shown in FIG. 19 is represented as a mechanical equivalent circuit, it will be one as shown in FIG. 20. FIG. 20 is a figure showing the mechanical equivalent circuit of the acoustic system 2 shown in FIG. 19. In FIG. 20: 300 is an equivalent circuit that indicates the whole loudspeaker unit 13; 301 is a capacitance component that indicates the acoustic stiffness of the first cavity R1; 302 is an equivalent circuit that indicates the whole vibration device 10; 303 is a capacitance component that indicates the stiffness of the support system of the vibration device 10; 304 is a capacitance component that indicates the negative stiffness of the vibration device 10; 305 is a capacitance component that indicates the acoustic stiffness of the second cavity R2; 306 is a negative stiffness which is the total attractive force of the vibration device 10 obtained by adding the stiffness of the support system and the negative stiffness (hereinafter, referred to as a total negative stiffness); and 307 to 309 are transformers that render a machine-acoustic transduction. In FIG. 20, the capacitance component 304 that indicates the negative stiffness differs from a general capacitance component and takes a "−" value, thus is distinguished by placing a ○ thereon.

Figure 21:
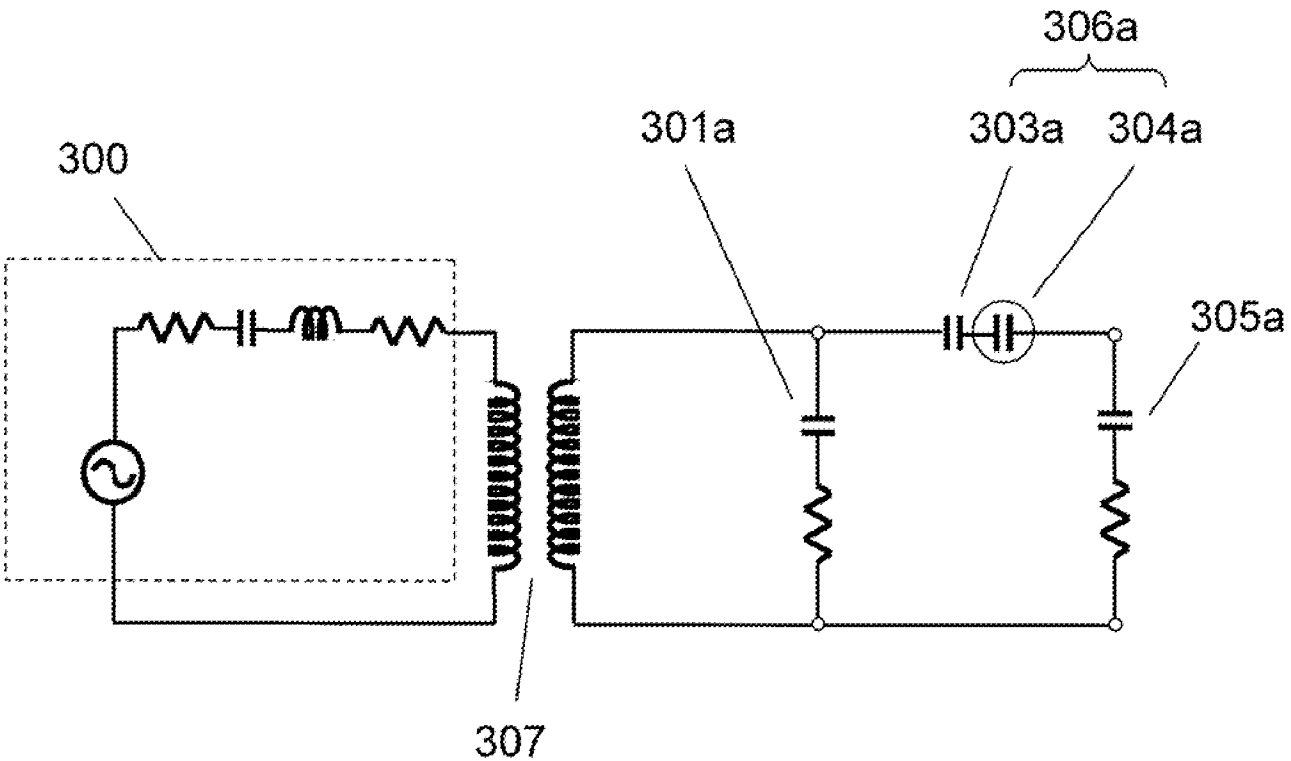
FIG. 21 is a figure showing a mechanical equivalent circuit representing an operation, at a low frequency, of the acoustic system 2 shown in FIG. 19.

Furthermore, a mechanical equivalent circuit representing an operation at a low frequency is shown in FIG. 21. FIG. 21 is a figure showing the mechanical equivalent circuit representing the operation of the acoustic system 2 shown in FIG. 19 at a low frequency. At a low frequency, the capacitance component that indicates the stiffness component becomes dominant. Therefore, the mechanical equivalent circuit can be represented merely by: the equivalent circuit 300 that indicates the whole loudspeaker unit 13; the capacitance component 301 that indicates the acoustic stiffness of the first cavity R1; the capacitance component 305 that indicates the acoustic stiffness of the second cavity R2; and the capacitance component 306 which is the total negative stiffness. Additionally, if transformers 308 and 309 are brought together as loads that indicate the whole loudspeaker unit 13 in view from the equivalent circuit 300, the transformers 308 and 309 can be omitted by including their transformation ratios in each capacitance components as shown in FIG. 21. Therefore, in FIG. 21, after taking into consideration of the transformation ratios, the capacitance component 301 that indicates the acoustic stiffness of the first cavity R1 is defined as 301*a*, the capacitance component 305 that indicates the acoustic stiffness of the second cavity R2 is defined as 305*a*, the capacitance component 306 which is the total negative stiffness is defined as 306*a*, the capacitance component 303 that indicates the stiffness of the support system is defined as 303*a*; and the capacitance component 304 that indicates the negative stiffness is defined as 304*a*.

As can been seen in FIG. 21, the capacitance component 304*a* that indicates the negative stiffness of the vibration device 10 is connected so as to reduce the capacitance component 305*a* that indicates the acoustic stiffness of the second cavity R2. From this, it can be understood that the negative stiffness of the vibration device 10 reduces the acoustic stiffness of the second cavity R2, thus the capacity expansion effect can be obtained in the acoustic system 2.

As described above, in the acoustic system 2 according to the current embodiment, the loudspeaker unit 13 for generating a sound in accordance with the acoustic signal and the vibration device 10 for generating the negative stiffness are separate. Therefore, a conventional loudspeaker unit can be used as the loudspeaker unit 13; thus, unlike the conventional art shown in FIG. 30, there is an advantage of not requiring an additional mechanism for generating the negative stiffness for the loudspeaker unit 13.

(Fourth Embodiment)

Figure 22:
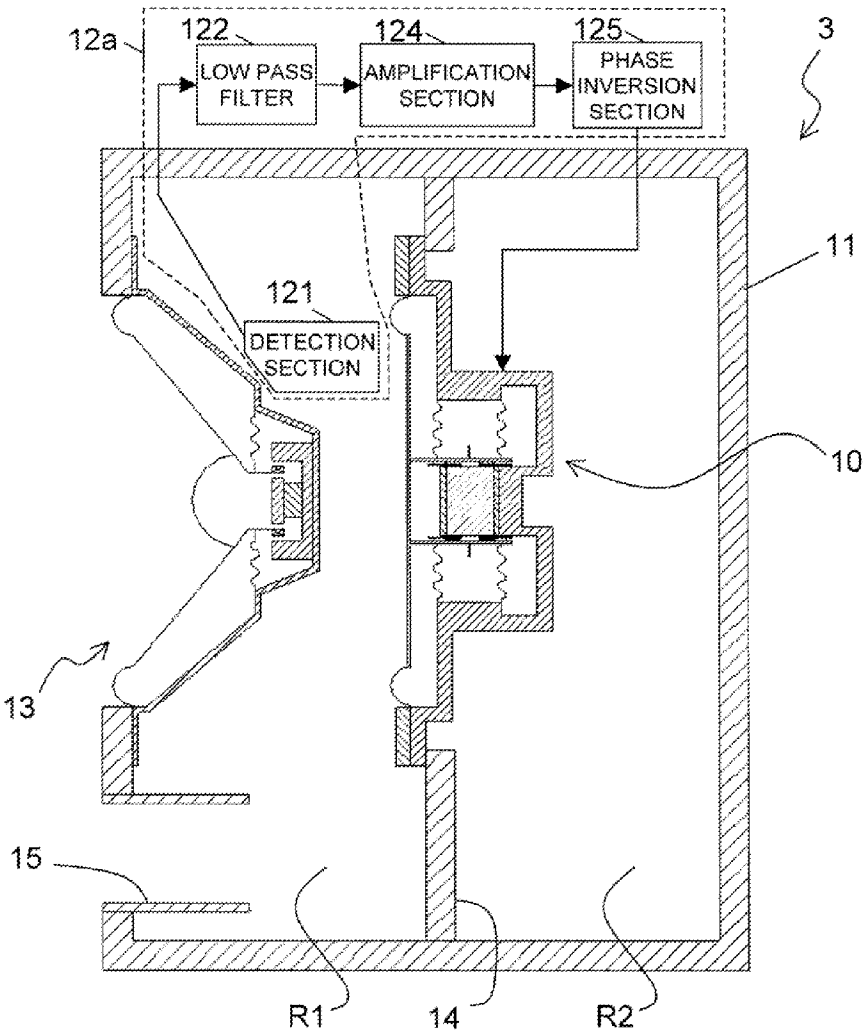
FIG. 22 is a structural profile of an acoustic system 3.

With reference to FIG. 22, an acoustic system 3 according to a fourth embodiment will be described. FIG. 22 is a structural profile of the acoustic system 3 according to the fourth embodiment. In an example in FIG. 22, a bass-reflex type loudspeaker system, in which an acoustic port is applied, is adopted as the acoustic system. In FIG. 22, the acoustic system 3 includes: the vibration device 10; the cabinet 11; the control section 12*a*; the loudspeaker unit 13; the partition plate 14; and an acoustic port 15. The different point between the acoustic system 3 and the acoustic system 2 shown in FIG. 19 is a point that the acoustic port 15 is further included. Other configurations are similar to those in the acoustic system 2, thus identical reference numerals are given and descriptions are omitted. In the following, a description centering on the differing point is provided.

The acoustic port 15, is attached to the cabinet 11 so as to be in contact with the first cavity R1, and acoustically connects the first cavity R1 and outside the cabinet 11.

An operation of the acoustic system 3 configured as above will be described. When the acoustic signal is inputted into the loudspeaker unit 13, the diaphragm of the loudspeaker unit 13 vibrates, and a sound in accordance with the acoustic signal is generated. This sound vibrates the diaphragm 108 of the vibration device 10 via the first cavity R1. As describe in the first embodiment, the negative stiffness is generated in response to the vibrational displacement of the diaphragm 108. Furthermore, as described in the third embodiment, the control section 12*a* controls the vibration of the vibration device 10 so as to constantly maintain the vibration center of the vibration system member in the balancing position. In addition, by means of the acoustic port 15, one part of the cabinet 11 where the first cavity R1 is formed act as a general phase inversion type cabinet. As a result, the acoustic system 3 becomes a loudspeaker system that has an expanded low frequency range.

Figure 23:
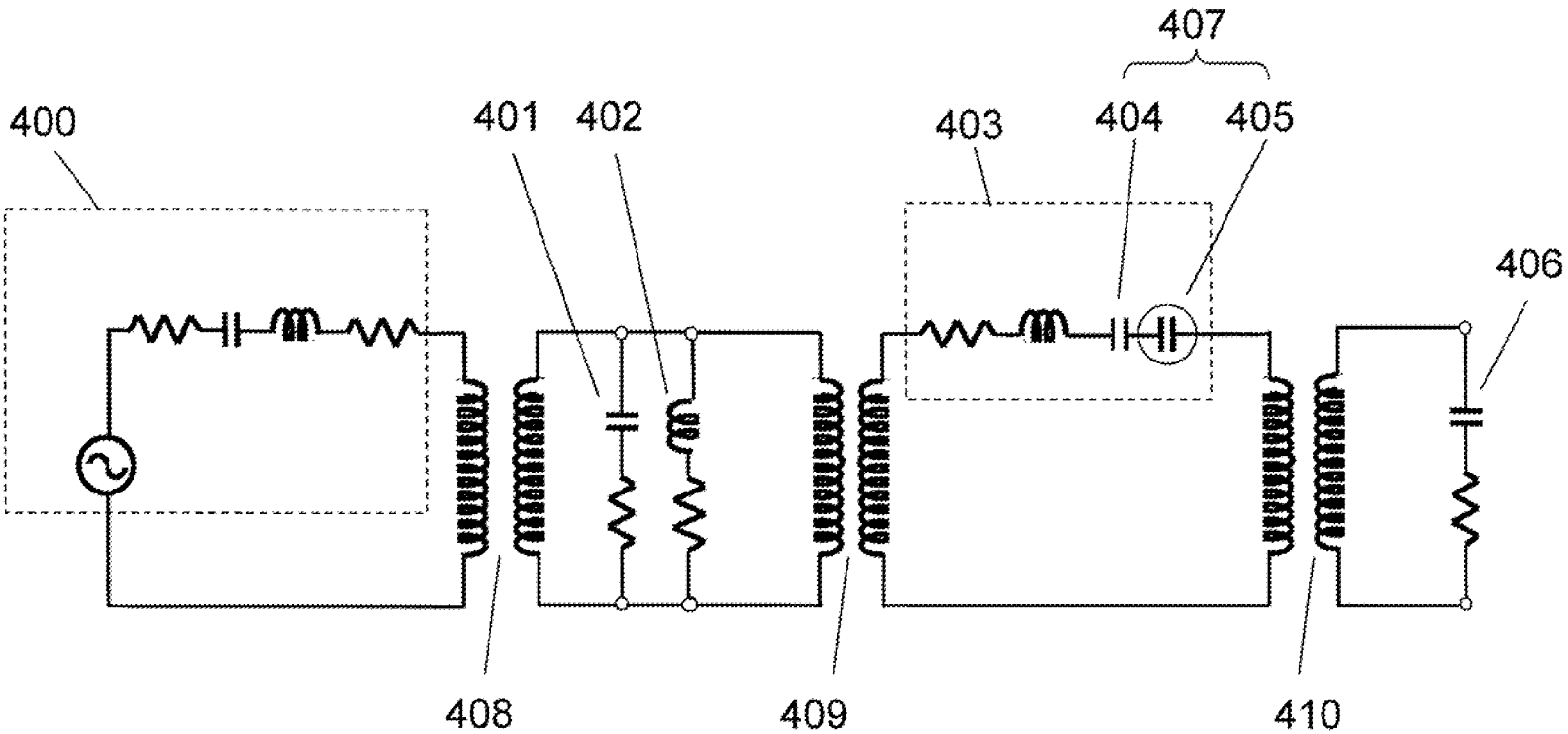
FIG. 23 is a figure showing a mechanical equivalent circuit of the acoustic system 3 shown in FIG. 22.

Here, if the acoustic system 3 shown in FIG. 22 is represented as a mechanical equivalent circuit, it will be one as shown in FIG. 23. FIG. 23 is a figure showing the mechanical equivalent circuit of the acoustic system 3 shown in FIG. 22. In FIG. 23: 400 is an equivalent circuit that indicates the whole loudspeaker unit 13; 401 is a capacitance component that indicates the acoustic stiffness of the first cavity R1; 402 is an inductance component that indicates the acoustic port 15; 403 is an equivalent circuit that indicates the whole vibration device 10; 404 is a capacitance component that indicates the stiffness of the support system of the vibration device 10; 405 is a capacitance component that indicates the negative stiffness of the vibration device 10; 406 is a capacitance component that indicates the acoustic stiffness of the second cavity R2; 407 is the total negative stiffness of the vibration device 10 obtained by adding the stiffness of the support system and the negative stiffness; and 408 to 410 are transformers that render a machine-acoustic transduction. In FIG. 23, the capacitance component 405 that indicates the negative stiffness differs from a general capacitance component and takes a "−" value, thus is distinguish by placing a ○ thereon.

Figure 24:
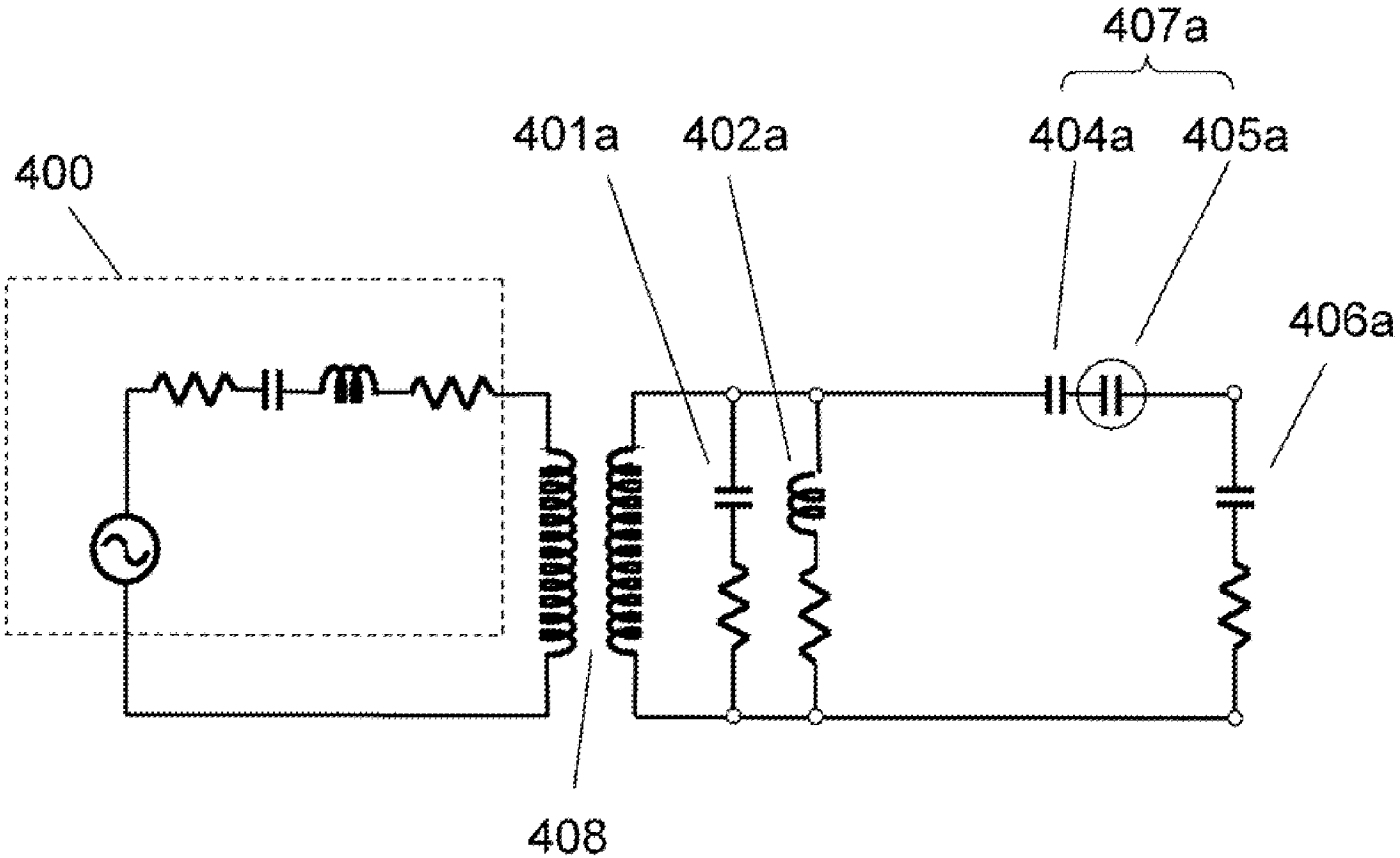
FIG. 24 is a figure showing a mechanical equivalent circuit representing an operation, at a low frequency, of the acoustic system 3 shown in FIG. 22.

Furthermore, a mechanical equivalent circuit representing an operation at a low frequency is shown in FIG. 24. FIG. 24 is a figure showing the mechanical equivalent circuit representing the operation of the acoustic system 3 shown in FIG. 22 at a low frequency. At a low frequency, the capacitance component that indicates the stiffness component becomes dominant. Therefore, the mechanical equivalent circuit can be represented merely by: the equivalent circuit 400 that indicates the whole loudspeaker unit 13; the capacitance component 401 that indicates the acoustic stiffness of the first cavity R1; the inductance component 402 that indicates the acoustic port 15; the capacitance component 406 that indicates the acoustic stiffness of the second cavity R2; and the capacitance component 407 which is the total negative stiffness. Additionally, if transformers 409 and 410 are brought together as loads that indicates the whole loudspeaker unit 13 in view from the equivalent circuit 400, the transformers 409 and 410 can be omitted by including their transformation ratios in each capacitance components or in each inductance components as shown in FIG. 24. Therefore, in FIG. 24, after taking into consideration of the transformation ratios, the capacitance component 401 that indicates the acoustic stiffness of the first cavity R1 is defined as 401*a*, the inductance component 402 that indicates the acoustic port 15 is defined as 402*a*, the capacitance component 404 that indicates the stiffness of the support system is defined as 404*a*, the capacitance component 405 that indicates the negative stiffness is defined as 405*a*, the capacitance component 406 that indicates the acoustic stiffness of the second cavity R2 is defined as 406*a*, and the capacitance component 407 which is the total negative stiffness is defined as 407*a*.

As can been seen in FIG. 24, the capacitance component 405*a* that indicates the negative stiffness of the vibration device 10 is connected so as to reduce the capacitance component 406*a* that indicates the acoustic stiffness of the second cavity R2. Here, from the mechanical equivalent circuit in FIG. 23, when, the acoustic stiffness of the first cavity R1 is defined as Sb1, the acoustic stiffness of the second cavity R2 is defined as Sb2, the negative stiffness is defined as Sn, and the mass component of the acoustic port 15 is defined as Mp, the a resonance frequency fbn of the acoustic system 3 can be described by formula (10).

[Formula 10]

$$fbn = \frac{1}{2\pi} \cdot \sqrt{\frac{Sb1 \cdot (Sb2 - Sn)}{\frac{(Sb1 + Sb2 - Sn)}{Mp}}} \tag{10}$$

From formula (10), it can be understood that if the negative stiffness Sn acts on the acoustic stiffness Sb2 of the second cavity R2, the resonance frequency fbn is reduced and a reproduction limit of low frequencies can be extended lower.

Figure 30:
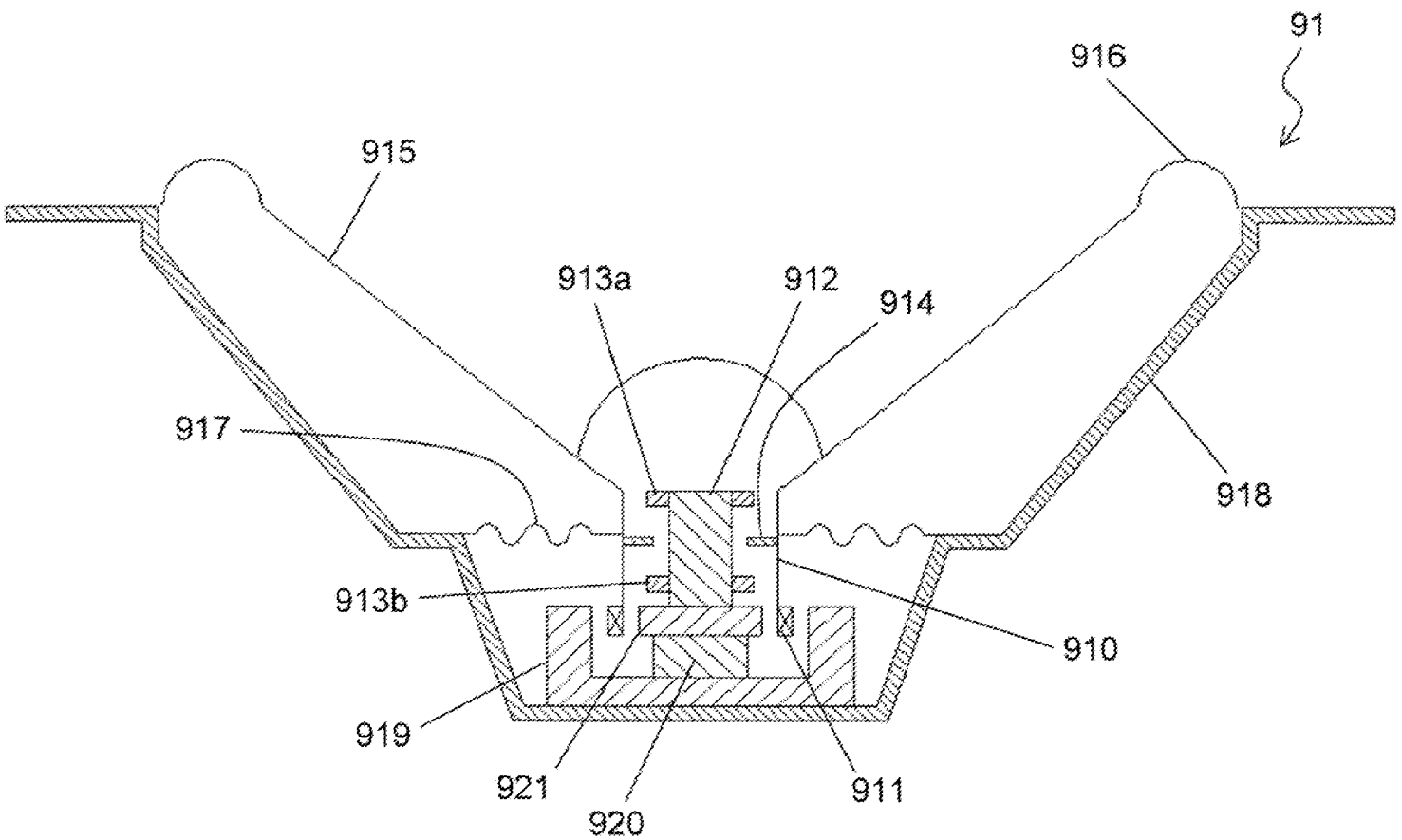
FIG. 30 PRIOR ART
FIG. 30 is a figure showing a structure of a conventional vibration device 91.
Figure 32:
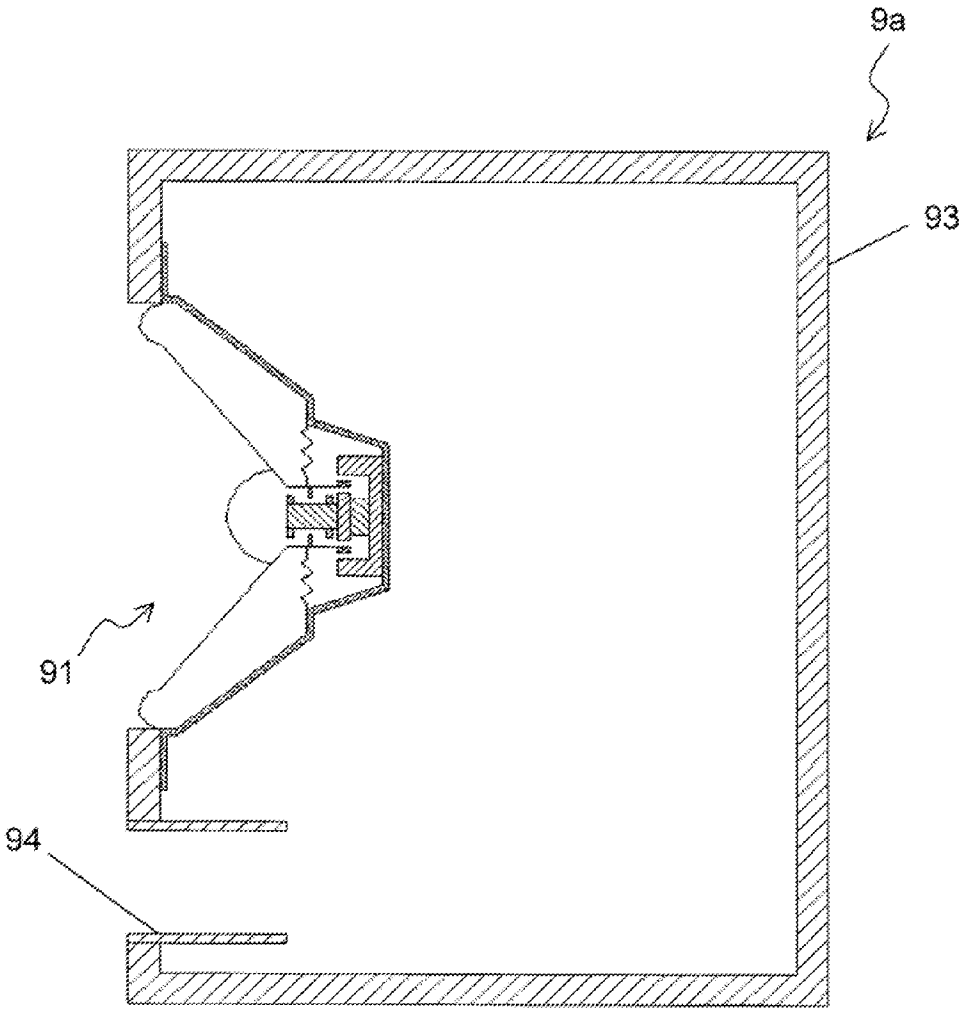
PRIOR ART FIG. 32
FIG. 32 is a structural profile of a bass-reflex type acoustic system 9*a* in which the conventional vibration device 91 is applied.
Figure 33:
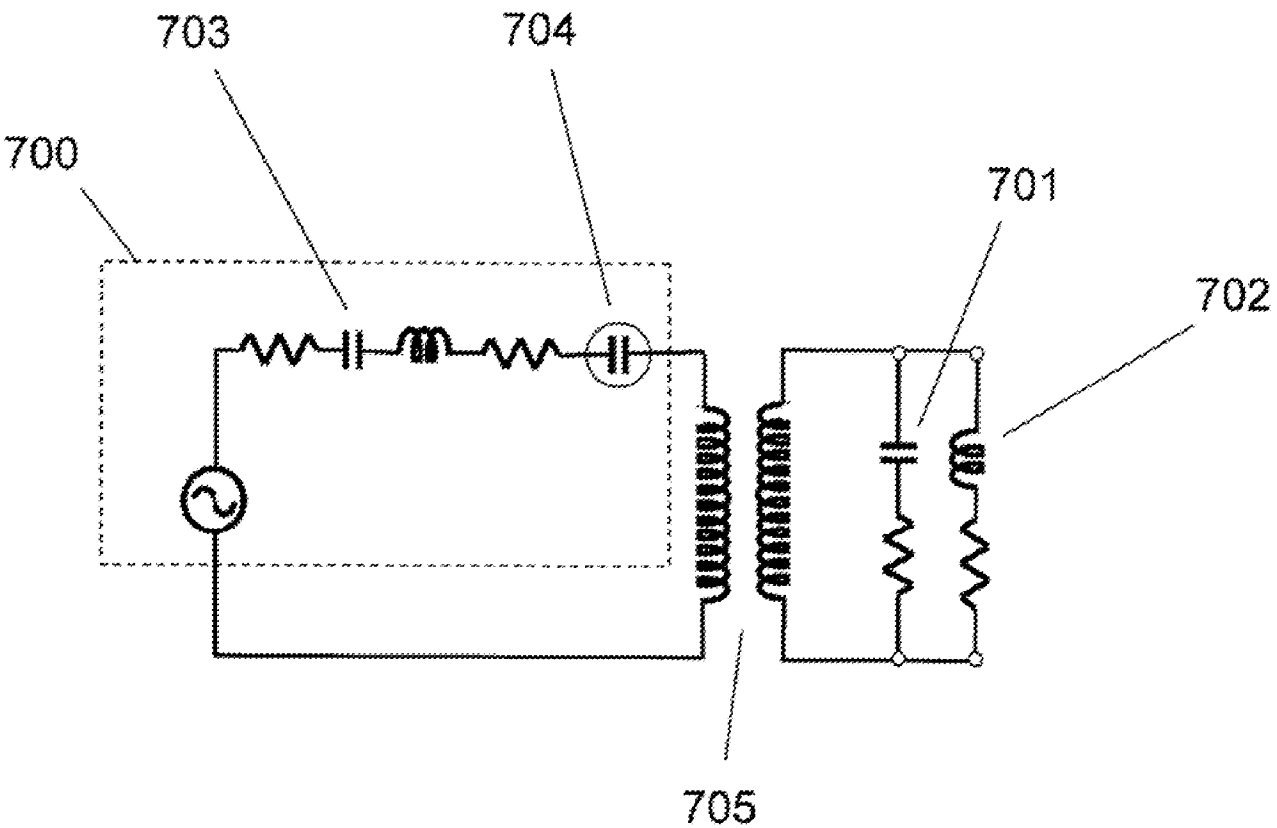
PRIOR ART FIG. 33
FIG. 33 is a figure showing a mechanical equivalent circuit of the acoustic system 9*a* shown in FIG. 32.

On the other hand, if the conventional vibration device 91 shown in FIG. 30 is applied in a bass-reflex type acoustic system, it will be one as shown in FIG. 32. FIG. 32 is a structural profile of a bass-reflex type acoustic system 9*a* in which the conventional vibration device 91 is applied. In FIG. 32, the acoustic system 9*a* includes: the cabinet 93; the vibration device 91; and an acoustic port 94. If a volume of a cavity inside the cabinet 93 is a total of the first cavity R1 and the second cavity R2 in FIG. 22, the acoustic stiffness Sb due to the cavity inside the cabinet 93 is Sb=Sb1+Sb2. A mechanical equivalent circuit in this situation is will be one as shown in FIG. 33. FIG. 33 is a figure showing the mechanical equivalent circuit of the acoustic system 9*a* shown in FIG. 32. In FIG. 33: 700 is an equivalent circuit that indicates the whole vibration device 91; 701 is a capacitance component that indicates the acoustic stiffness of the cavity inside the cabinet 93; 702 is an inductance component that indicates the acoustic port 94; 703 is a capacitance component that indicates the stiffness of the support system of the vibration device 91; 704 is a capacitance component that indicates the negative stiffness of the vibration device 91; 705 is a transformer that renders the machine-acoustic transduction. In FIG. 33, the capacitance component 704 that indicates the negative stiffness differs from a general capacitance component and takes a "−" value, thus is distinguished by placing a ○ thereon.

From FIG. 33, it can be understood that the capacitance component 704 that indicates the negative stiffness does not act upon the capacitance component 701 that indicates the acoustic stiffness of the cavity inside the cabinet 93. Here, from the mechanical equivalent circuit in FIG. 33, when, the acoustic stiffness of the cavity inside the cabinet 93 is defined as Sb, and the mass component of the acoustic port 94 is defined as Mp, a resonance frequency fb of the acoustic system 9*a* can be described by formula (11).

[Formula 11]

$$fb = \frac{1}{2\pi} \cdot \sqrt{\frac{Sb}{Mp}} \tag{11}$$

From formula (11), it can be understood that the negative stiffness Sn does not act upon the acoustic stiffness Sb of the cavity inside the cabinet 93, and the resonance frequency fbn does not become reduced depending on the negative stiffness Sn. Thus, with a configuration of the conventional acoustic system 9*a*, the operation becomes identical to the general bass-reflex type loudspeaker, thus cannot obtain an advantageous effect of extending the reproduction limit of low frequencies.

As described above, with the acoustic system 3, the bass-reflex type loudspeaker system is attained by applying both the loudspeaker unit 13 and the vibration device 10. With this, in the bass-reflex type, the acoustic stiffness of the second cavity R2 can be subjected with the action of the negative stiffness. As a result, the reproduction limit of low frequencies can be further expanded toward a lower frequency by the negative stiffness.

Figure 25:
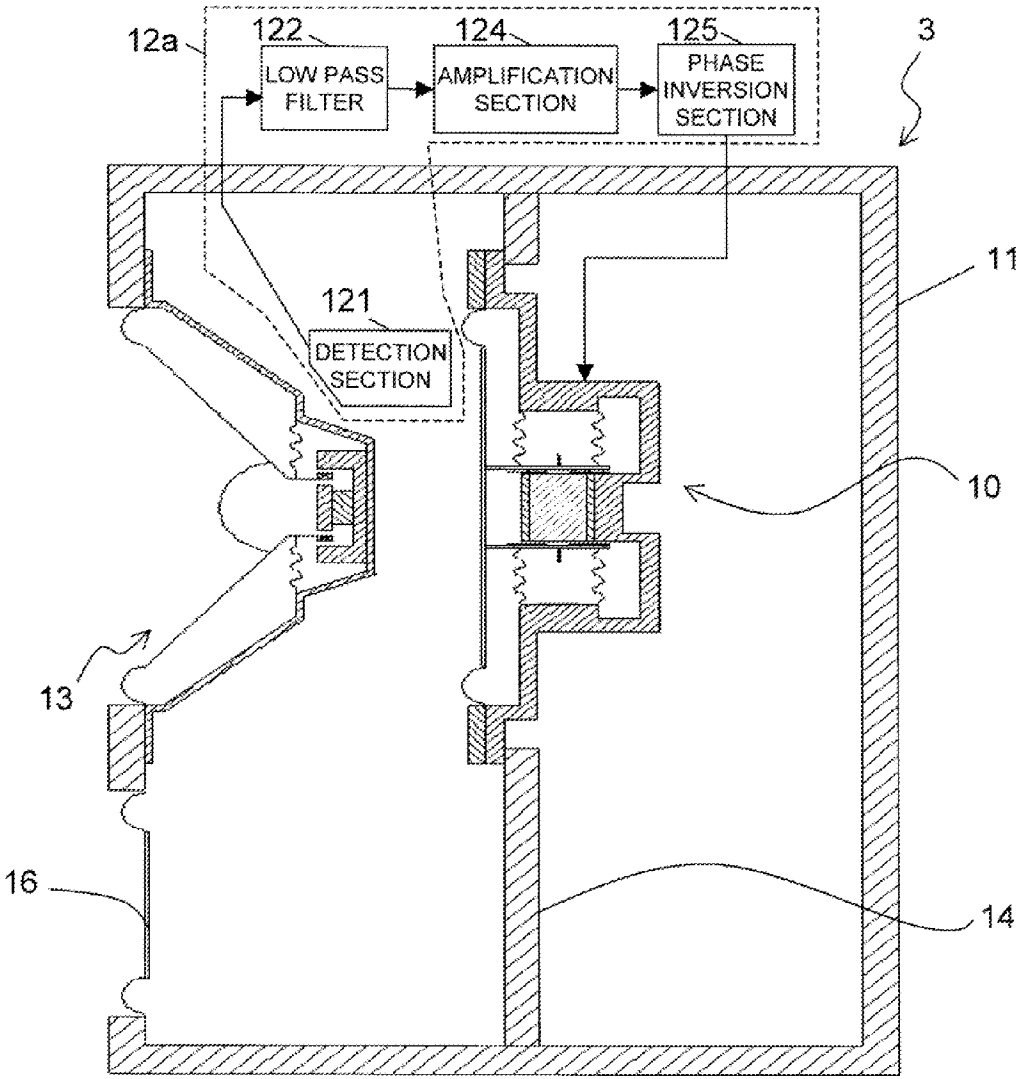
FIG. 25 is a structural profile of the acoustic system 3 in which a drone cone 16 applied.

In the current embodiment, although the acoustic port 15 is used in order to realize the bass-reflex type, it is not limited to this configuration. For example, as shown in FIG. 25, a drone cone 16 can be applied in order to realize the bass-reflex type. FIG. 25 is a structural profile of the acoustic system 3 in which the drone cone 16 is applied. In FIG. 25, the drone cone 16, is attached to the cabinet 11 so as to be in contact with the first cavity R1, and acoustically connects the first cavity R1 and the outside of the cabinet 11.

Figure 26:
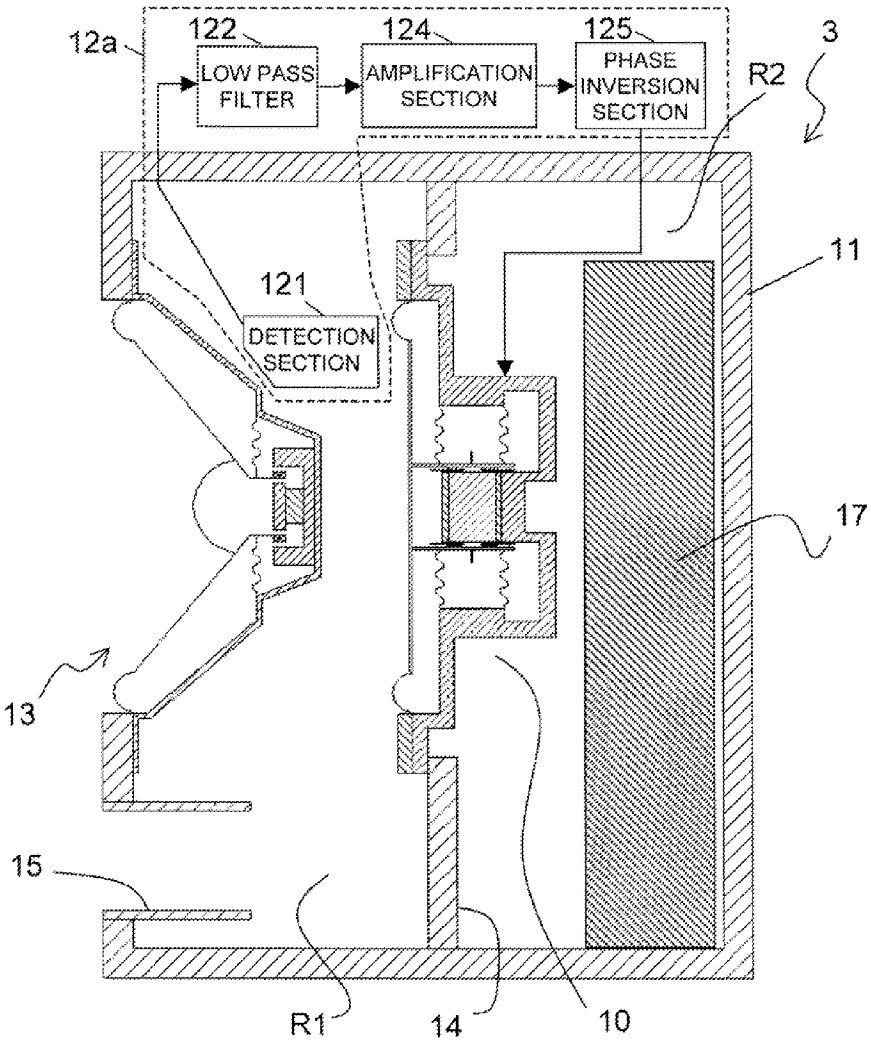
FIG. 26 is a figure showing an example where a gas adsorption body 17 is disposed inside a second cavity R2 of the acoustic system 3.

In the acoustic systems 1 to 3 described above, a gas adsorption body may be further included inside the cabinet 11. The gas adsorption body is an activated carbon and the like, and is constructed from a material that has an advantageous effect of equivalently expanding the capacity inside the cabinet 11 by allowing physical adsorption of a gas inside the cabinet 11. FIG. 26 is a figure showing an example where a gas adsorption body 17 is disposed in the second cavity R2 of the acoustic system 3. As shown in FIG. 26, by applying the gas adsorption body 17, the capacity of the second cavity R2 can be equivalently expanded, and the reproduction limit of low frequencies can be further expanded toward a lower frequency. Since the advantageous effect of expanding the capacity becomes lower if the gas adsorption body 17 adsorbs molecules other than air such as moisture, the gas adsorption body 17 is desirably used in a sealed cavity. With regard to this, the second cavity R2 is sealed in the structure in FIG. 26. Therefore, with the structure in FIG. 26, the reproduction limit of low frequencies can be further expanded toward a lower frequency as a result of the bass-reflex type, while maintaining the advantageous effect of the gas adsorption body 17 of expanding the capacity.

Figure 27:
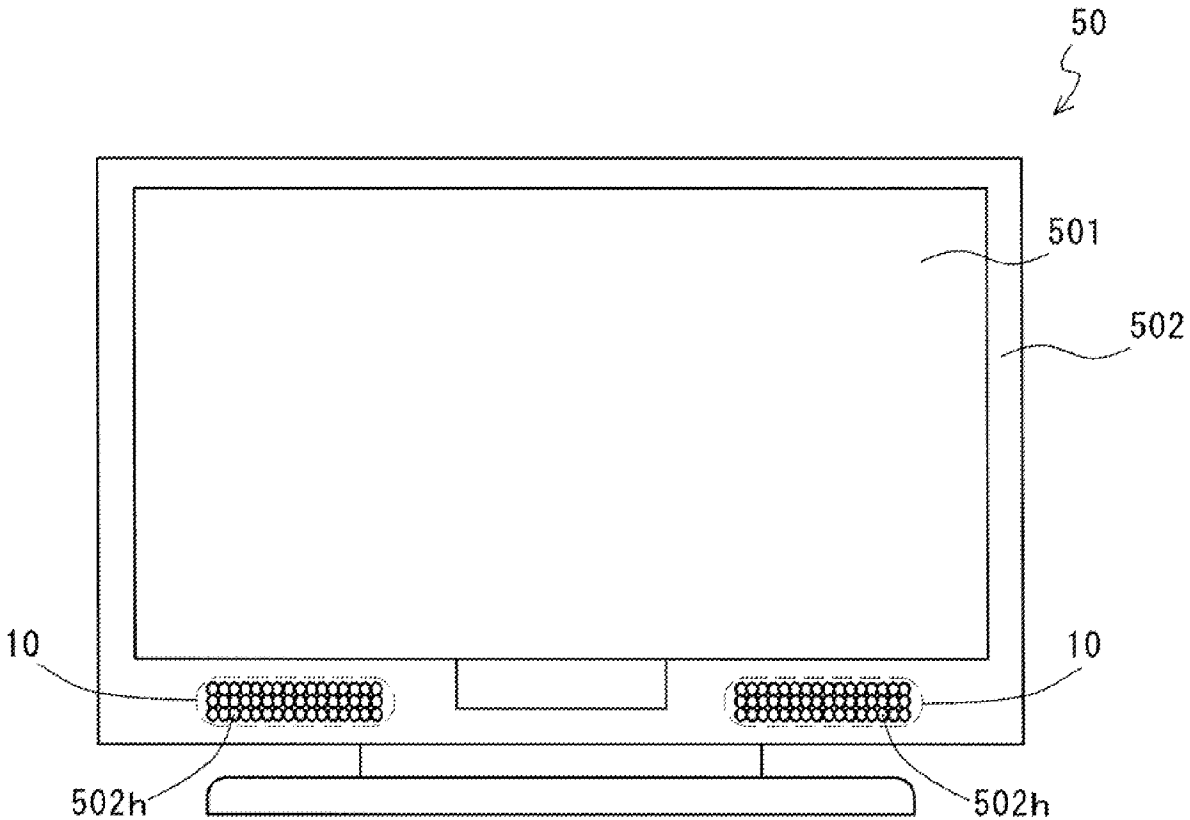
FIG. 27 is a figure showing a thin-screen television.

Furthermore, the vibration devices 10 and 20, and the acoustic systems 1 to 3: can be mounted in an audio-visual apparatus which is an electronic device such as, a personal computer, a thin-screen television, and the like; and will be disposed inside an apparatus chassis that is provided on the audio-visual apparatus. In the following, an example where the vibration device 10 is mounted in, as one example, a thin-screen television will be described. FIG. 27 is a figure showing a thin-screen television.

In FIG. 27, a thin-screen television 50 includes: a liquid crystal display 501; an apparatus chassis 502; and two vibration devices 10. The liquid crystal display 501 is attached to the apparatus chassis 502. A Plurality of opening portions 502*h* are formed on the apparatus chassis 502. As indicated with dotted lines in FIG. 27, each of the vibration devices 10 is disposed on a lower side of the liquid crystal display 501 inside the apparatus chassis 502.

For example, when an acoustic signal originating from an audio system circuit (not diagrammatically represented) that is provided in the thin-screen television 50 is apply to each of the vibration devices 10, sounds in accordance with the acoustic signal is radiated from each of the vibration devices 10. The sounds radiated from each of the vibration devices 10 are radiate outside the apparatus chassis 502 via each of the plurality of opening portions 502*h*.

As described above, by mounting the vibration devices 10, which can generate the negative stiffness while ensuring a large vibrational amplitude, on the audio-visual apparatus, a sufficient low frequency sound reproduction can be attained in the audio-visual apparatus.

Figure 28:
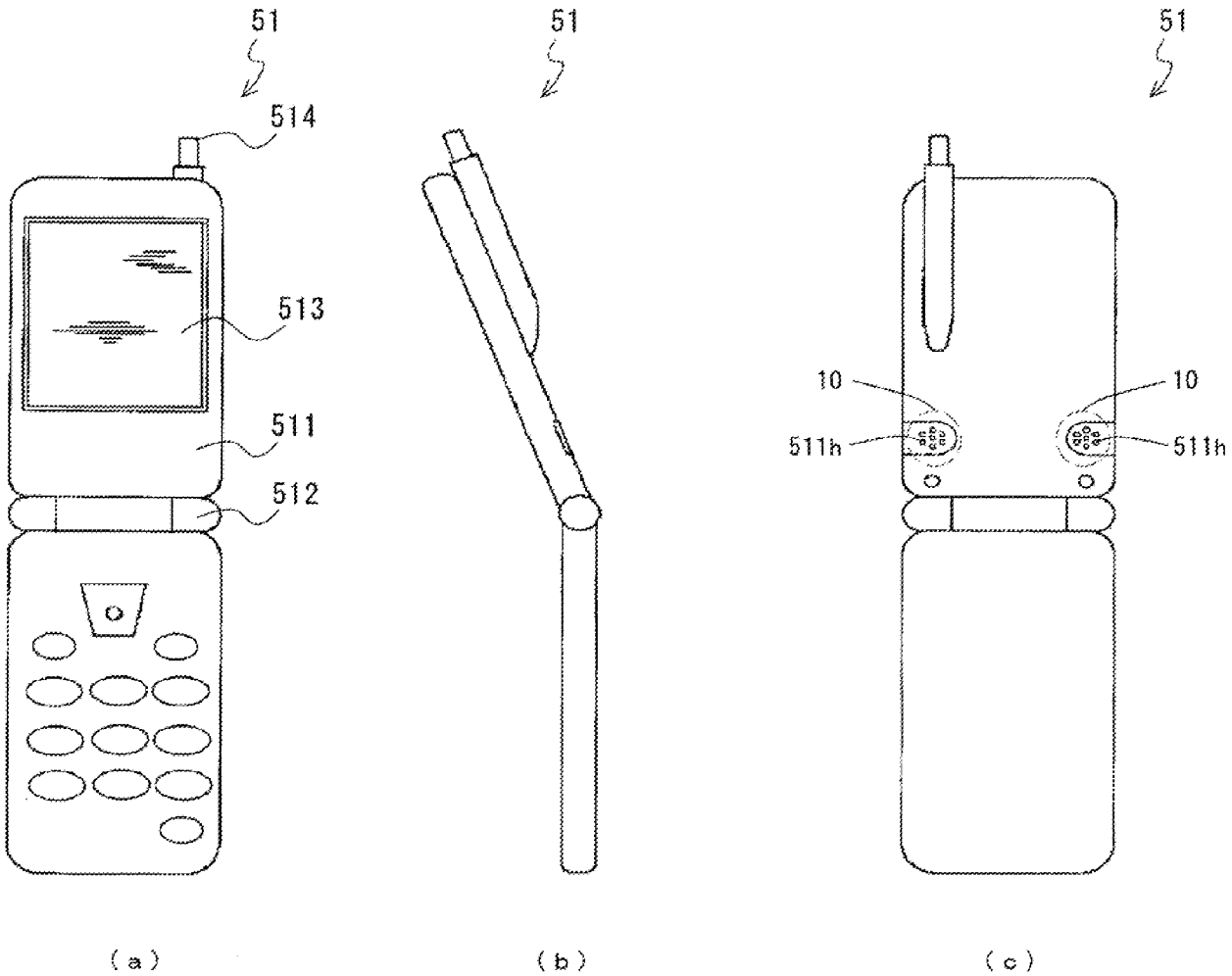
FIG. 28 is an exterior view of a mobile phone.

Furthermore, the vibration devices 10 and 20, and the acoustic systems 1 to 3 can be mounted in a portable information processing device which is an electronic device such as, a mobile phone, a PDA, and the like. Beside the mobile phone and the PDA, portable apparatuses such as, a portable radio, a portable television, an HDD player, a semiconductor memory player, and the like can be listed as examples of the portable information processing device. In the following, an example where the vibration device 10 is mounted in, as one example, a mobile phone will be described. FIG. 28 is an exterior view of the mobile phone, while (a) is a front view, (b) is a side view, and (c) is a rear view.

In FIG. 28, a mobile phone 51 includes: a device chassis 511; a hinge portion 512; a liquid crystal display 513; an antenna 514; and two vibration devices 10. The liquid crystal display 513 is attached to the device chassis 511. As shown in FIG. 28(*c*), a plurality of opening portions 511*h* are formed on the back surface of the device chassis 511. As indicated with dotted lines in FIG. 28(*c*), each of the vibration devices 10 is disposed on a back surface side of the inside of the device chassis 511.

For example, when the mobile phone 51 receives a reception signal from the antenna 514, the reception signal is appropriately processed at a signal processing section (not diagrammatically represented), and is inputted into the vibration devices 10. If the reception signal is, for example, a melody signal requesting for attention upon reception, a melody sound is radiated from the vibration devices 10. The melody sound radiated from each of the vibration devices 10 are respectively radiate outside the device chassis 511 via the plurality of opening portions 511*h*.

As described above, by mounting the vibration devices 10, which can generate the negative stiffness while ensuring a large vibrational amplitude, on the portable information processing device, a sufficient low frequency sound reproduction can be attained in the portable information processing device.

Figure 29:
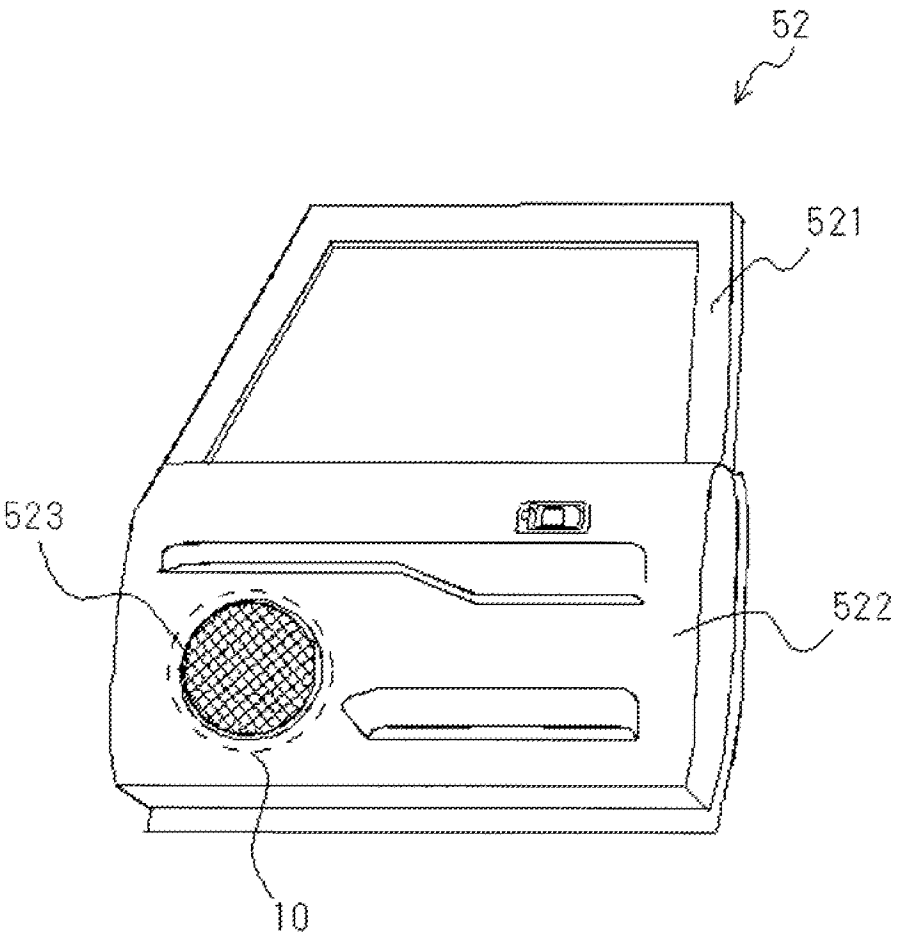
FIG. 29 is a figure showing an automobile door.

Furthermore, the vibration devices 10 and 20, and the acoustic systems 1 to 3 can be mounted in a vehicle such as an automobile. The vibration devices 10 and 20, and the acoustic systems 1 to 3 are disposed inside a vehicle body. In the following, an example where the vibration device 10 is mounted, as one example, in a door of an automobile will be described. FIG. 29 is a figure showing a door of an automobile.

In FIG. 29, a door 52 of the automobile includes: a window section 521; a door main body 522; a punching net 523; and the vibration device 10. The vibration device 10 is disposed inside the door main body 522 as indicated by a dotted line in FIG. 29. The punching net 523 is attached to the door main body 522 so as to be disposed on the front surface of the vibration device 10.

For example, when an acoustic signal is applied to the vibration device 10 from an audio device (not diagrammatically represented) such as a CD player and the like disposed within the vehicle, a sound in accordance with the acoustic signal is radiated from the vibration device 10. The sound radiated from the vibration device 10 is radiated within the vehicle via the punching net 523.

As described above, by mounting the vibration device 10, which can generate the negative stiffness while ensuring a large vibrational amplitude, in the vehicle, a sufficient low frequency sound reproduction can be attained in the vehicle.

Industrial Applicability

A vibration device according to the present invention can generate a negative stiffness while ensuring a large vibrational amplitude, and can be utilized in an audio-visual apparatus such as a liquid crystal display television, a PDP, and the like in which advancement in size-reduction is progressing, or can be utilized in a stereo device, an automobile mounted device, and the like.

The invention claimed is:

1. A vibration device that vibrates in response to an input electrical signal, the vibration device comprising:

a diaphragm;

a support system member that supports the diaphragm in a manner that allows the diaphragm to vibrate;

a tubular voice coil bobbin attached to the diaphragm;

a magnet which is disposed on at least one side among an inner circumferential surface side and an outer circumferential surface side of the tubular voice coil bobbin, which is polarized in a vibration direction of the diaphragm, and which forms a magnetic gap on a side that faces the tubular voice coil bobbin;

a voice coil which is attached to the tubular voice coil bobbin so as to be disposed within the magnetic gap, which receives the input electrical signal, and which generates a driving force by the input electrical signal having been received and the magnetic gap formed by the magnet, to vibrate the diaphragm and the tubular voice coil bobbin; and a magnetic material member which is attached to the tubular voice coil bobbin so as to be disposed in a balancing position within the magnetic gap, and which is, when vibrating together with the tubular voice coil bobbin, subjected to an action of a magnetic attractive force generated by the magnet in a direction away from the balancing position.

2. The vibration device according to claim 1, further comprising a plate formed from a magnetic material, which is attached to at least one surface among two magnetic pole surfaces of the magnet.

3. The vibration device according to claim 1, wherein the magnet comprises a first magnet disposed on the inner circumferential surface side of the tubular voice coil bobbin and a second magnet disposed on the outer circumferential surface side of the tubular voice coil bobbin; and a polarization direction of the first magnet that is disposed on the inner circumferential surface side and a polarization direction of the second magnet that is disposed on the outer circumferential surface side, are opposite.

4. The vibration device according to claim 3, wherein a thickness, in the vibration direction of the diaphragm, of the first magnet that is disposed on the inner circumferential surface side is larger than a thickness, in the vibration direction of the diaphragm, of the second magnet that is disposed on the outer circumferential surface side.

5. An acoustic system comprising:

a cabinet; and the vibration device according to claim 1 attached to the cabinet.

6. The acoustic system according to claim 5, further comprising control means that outputs, to the voice coil, as the input electrical signal, a control signal for controlling a vibration center of the magnetic material member to be in the balancing position.

7. The acoustic system according to claim 6, wherein the control means includes:

a detection section which detects a vibrational displacement of the magnetic material member, and which outputs a displacement signal that indicates the detected vibrational displacement;

a low pass filter that allows, among displacement signals outputted from the detection section, only a displacement signal having a frequency lower than an audible range to pass through;

an amplification section that amplifies the displacement signal which has passed through the low pass filter with a predefined gain; and a phase inversion section which inverts a phase of the displacement signal amplified by the amplification section, and which outputs, to the voice coil, a resulting signal as the control signal.

8. The acoustic system according to claim 7, wherein a plurality of the voice coils are provided;

the plurality of the voice coils are attached to the tubular voice coil bobbin so as to be disposed within the magnetic gap at positions away from each other in the vibration direction of the diaphragm; and the phase inversion section outputs the control signal to each of the plurality of the voice coils.

9. The acoustic system according to claim 7, wherein a relationship of $Ga>(Re\cdot Sm)/(B\cdot 1\cdot Gx)$ is satisfied, when the predefined gain is defined as Ga, a direct current resistance of the voice coil is defined as Re, a stiffness that acts upon the diaphragm is defined as Sm, a magnetic flux density within the magnetic gap is defined as B, a coil length of the voice coil is defined as 1, and a gain of the detection section is defined as Gx.

10. The acoustic system according to claim 5, further comprising a gas adsorption body which is disposed inside the cabinet, and which has an effect of equivalently expanding a capacity inside the cabinet, by physically adsorbing a gas inside the cabinet.

11. An acoustic system comprising:

a cabinet;

a partition plate which is provided inside the cabinet, and which divides a cavity inside the cabinet into a first cavity and a second cavity;

a loudspeaker unit which is attached to the cabinet so as to be in contact with the first cavity, and which generates a sound in accordance with an inputted acoustic signal; and the vibration device according to claim 1 attached to the partition plate.

12. The acoustic system according to claim 11, further comprising either a drone cone or an acoustic port, which is attached to the cabinet so as to be in contact with the first cavity, and which acoustically connects the first cavity and the outside of the cabinet.

13. The acoustic system according to claim 11, further comprising control means that outputs, to the voice coil, as the input electrical signal, a control signal for controlling a vibration center of the magnetic material member to be in a balancing position within the magnetic gap.

14. The acoustic system according to claim 13, wherein the control means includes:

a detection section which detects a vibrational displacement of the magnetic material member, and which outputs a displacement signal that indicates the detected vibrational displacement;

a low pass filter that allows, among displacement signals outputted from the detection section, only a displacement signal having a frequency lower than an audible range to pass through;

an amplification section that amplifies the displacement signal which has passed through the low pass filter with a predefined gain; and a phase inversion section which inverts a phase of the displacement signal amplified by the amplification section, and which outputs, to the voice coil, a resulting signal as the control signal.

15. The acoustic system according to claim 14, wherein a plurality of the voice coils are provided;

the plurality of voice coils are attached to the tubular voice coil bobbin so as to be disposed within the magnetic gap at positions away from each other in the vibration direction of the diaphragm; and the phase inversion section outputs the control signal to each of the plurality of the voice coils.

16. The acoustic system according to claim 14, wherein a relationship of $Ga>(Re \cdot Sm)/(B \cdot 1 \cdot Gx)$ is satisfied, when the predefined gain is defined as Ga, a direct current resistance of the voice coil is defined as Re, a stiffness that acts upon the diaphragm is defined as Sm, a magnetic flux density within the magnetic gap is defined as B, a coil length of the voice coil is defined as 1, and a gain of the detection section is defined as Gx.

17. The acoustic system according to claim 11, further comprising a gas adsorption body which is disposed inside the second cavity, and which has an effect of equivalently expanding a capacity inside the second cavity, by physically adsorbing a gas inside the second cavity.

18. A vehicle comprising:

the vibration device according to claim 1; and a vehicle body in which the vibration device is provided.

19. An audio-visual apparatus comprising:

the vibration device according to claim 1; and an apparatus chassis in which the vibration device is provided.

20. A portable information processing device comprising:

the vibration device according to claim 1; and a device chassis in which the vibration device is provided.

* * * * *